US005943073A

United States Patent [19]

Otsuka et al.

[11] Patent Number: 5,943,073

[45] **Date of Patent: *Aug. 24, 1999**

[54] INK JET RECORDING APPARATUS AND METHOD

[75] Inventors: Naoji Otsuka, Yokohama; Atsushi Arai, Kawasaki; Kentaro Yano, Yokohama; Kiichiro Takahashi; Hitoshi Nishikori, both of Kawasaki; Osamu Iwasaki, Tokyo; Daigoro Kanematsu, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/174,696

[22] Filed: Dec. 28, 1993

[30] Foreign Application Priority Data

| | | | |
|---|---|---|---|
| Jan. 1, 1993 | [JP] | Japan | 5-015089 |
| Jan. 1, 1993 | [JP] | Japan | 5-015090 |
| Jan. 1, 1993 | [JP] | Japan | 5-015091 |

[51] Int. Cl.[6] ..... B41J 2/05

[52] U.S. Cl. ..... 347/48; 347/57; 347/67; 347/94

[58] Field of Search ..... 347/6, 7, 9, 48, 347/67, 94, 15, 57

[56] References Cited

U.S. PATENT DOCUMENTS

| | | | |
|---|---|---|---|
| 4,296,421 | 10/1981 | Hara et al. | 347/48 |
| 4,313,124 | 1/1982 | Hara | 347/57 |
| 4,345,262 | 8/1982 | Shirato et al. | 347/57 |
| 4,459,600 | 7/1984 | Sato et al. | 347/57 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,646,110 | 2/1987 | Ikeda et al. | 347/48 X |
| 4,719,472 | 1/1988 | Arakawa | 347/67 |
| 4,723,129 | 2/1988 | Endo et al. | 347/63 |
| 4,740,796 | 4/1988 | Endo et al. | 347/56 |
| 5,021,809 | 6/1991 | Abe et al. | 347/56 |
| 5,053,787 | 10/1991 | Terasawa et al. | 347/48 X |

FOREIGN PATENT DOCUMENTS

| | | | |
|---|---|---|---|
| 04964533 | 7/1992 | European Pat. Off. | B41J 2/055 |
| 54-56847 | 5/1979 | Japan . | |
| 58-42466 | 3/1983 | Japan | 347/48 |
| 59-123670 | 7/1984 | Japan . | |
| 59-138461 | 8/1984 | Japan . | |
| 60-71260 | 4/1985 | Japan . | |
| 62-169657 | 7/1987 | Japan | B41J 3/04 |
| 62-238755 | 10/1987 | Japan | 347/48 |
| 1-308643 | 12/1989 | Japan | B41J 3/04 |
| 1-308644 | 12/1989 | Japan | B41J 3/04 |
| 2-111550 | 4/1990 | Japan | 347/94 |

*Primary Examiner*—Joseph Hartary
*Attorney, Agent, or Firm*—Fitzpatrick, Cella, Harper & Scinto

[57] ABSTRACT

An ink jet recording apparatus comprises an ejection orifice for ejecting an ink, a supply portion, communicating with the ejection orifice, for supplying an ink stored therein to the ejection orifice, an ejection energy producer, arranged in the supply portion, for applying energy for ink ejection to the ink, a pressure producer, arranged in the supply portion at a position different from the ejection energy producer, for producing a pressure wave in the supply portion, and a controller for controlling the pressure producer to produce a pressure wave different from a pressure wave produced in the supply portion by the ejection energy producer.

32 Claims, 25 Drawing Sheets

INK JET RECORDING APPARATUS AND METHOD

BACKGROUND OF THE INVENTION

1. Field of the Invention

The present invention relates to a recording head of an ink jet recording apparatus for performing recording by ejecting an ink from the recording head to a recording medium.

2. Related Background Art

Recording apparatuses such as a printer, a copying machine, a facsimile apparatus, and the like are designed to record an image consisting of a dot pattern on a recording medium such as a paper sheet, a plastic thin plate, or the like.

The recording apparatuses can be classified into an ink jet type, a wire dot type, a thermal type, a laser beam type, and the like. Of these apparatuses, an ink jet type apparatus (ink jet recording apparatus) performs recording by ejecting and flying ink (recording liquid) droplets from ejection orifices of a recording head, and attaching the droplets onto a recording medium.

In recent years, many recording apparatuses have been used, and they are increasingly demanded to meet high-speed recording, high-resolution, high-image quality, and low-noise requirements. As a recording apparatus which can meet these requirements, the ink jet recording apparatus is known. In this ink jet recording apparatus, since recording is performed by ejecting an ink from a recording head, a non-contact print operation can be realized, and hence, a very stable recorded image can be obtained.

However, since an ink jet recording system uses an ink as a fluid, various hydrodynamic problems occur when the system is used at a speed near or more than the upper-limit print speed of a recording head. Since an ink is a liquid, its physical states such as viscosity, surface tension, and the like considerably vary all the time depending on the environmental temperature or the leaving time of the ink. For this reason, even though a print operation is possible in a certain state, it may be disabled due to a change in environmental temperature, an increase in negative pressure caused by a decrease in ink remaining amount, or the like.

In many conventional apparatuses, in order to print a vertical line as linearly as possible, all of a plurality of nozzles are subjected to ink ejection within a time period as short as possible. For this purpose, several tens of nozzles are divided into groups each including several to 10 nozzles to shorten the ejection time as much as possible. In this case, when a recording head is used near an upper-limit ejection period, an ink cannot be refilled in the nozzles in time. For this reason, the next ejection is started before the ink is refilled, thus causing an ejection error and an extreme decrease in ejection amount. In particular, when ejection from a large number of nozzles is performed within a short period of time, the negative pressure level in a common liquid chamber temporarily becomes very high, and a refill operation cannot be performed in time. Also, a large vibration occurs due to resonance, and the next ejection is started in a state wherein the ink protrudes above the nozzle surface, resulting in splash-like ejection. In this manner, various vibration problems often occur in the conventional apparatus.

In order to solve the fluid vibration problems, some proposals have already been made. As one of these proposals, a method of forming a bubble in the common ink chamber or ink channels in a recording head is known. This method aims at solving the fluid vibration problems by the vibration absorption effect of the bubble. It is most effective to form a bubble near ejection nozzles which are basically vibration generation sources. As the bubble is formed nearer a tank, the effect is lessened, and a suppression effect of a high-frequency vibration generated by ejection is almost lost. Therefore, the bubble is formed in, e.g., the common ink chamber to obtain the vibration suppression effect.

However, the above-mentioned method suffers a problem of a long-lived bubble. Furthermore, since the method of absorbing a vibration using a bubble acts in a direction to absorb an ejection reactive pressure wave, it strongly acts as a vibration suppression effect. However, upon ejection of an ink, the backward impedance (an impedance at the upstream side of ink supply) of a foaming point also decreases, and conversion efficiency of foaming energy into ejection energy is impaired. Therefore, although the refill speed, the conversion efficiency, or the like can be increased or improved on the average, the original ejection characteristics of ejection nozzles cannot be perfectly utilized.

The setting position of an electrothermal energy converting element (to be simply referred to as a heater hereinafter) in the longitudinal direction of each nozzle will be discussed below.

As the heater position is selected to have a larger distance OH to an ejection orifice, energy efficiency becomes better. Foaming energy (ejection energy) obtained by driving the heater is consumed as energy for pushing an ink in both the direction of an ejection orifice and the direction of a common ink chamber. Typical factors influencing the impedance at that time include a fluid resistance (R) generated due to the viscosity of an ink upon movement of the ink, and an inertia (I) generated as energy for starting the ink to move. If the tube diameter of a nozzle is constant, since the fluid resistance (R) and the inertia (I) are proportional to the tube length, input energy can be efficiently converted into ejection energy by setting the OH for determining the forward impedance (an impedance at the downstream side of ink supply) to be sufficiently smaller than a distance HC to the common ink chamber, which distance determines the backward impedance (an impedance at the upstream side of the ink supply). However, the ink amount before the heater must be assured to have at least a capacity capable of forming a flying droplet, and it is impossible to infinitely decrease the OH. For this reason, the total length of the nozzle is prolonged to increase the backward impedance by setting the HC to be sufficiently large, so that the forward impedance becomes relatively small. With this arrangement, energy efficiency of input energy is improved.

However, in a conventional ink jet recording apparatus, the nozzle length is set to be relatively large to increase the backward impedance, and this arrangement is not suitable for a high-speed response. Refill power of an ink to a nozzle is mainly determined by the balance between the supply force of the ink generated by the surface tension (capillary force) of the ink itself, and the impedance of the nozzle upon refill of the ink. For this reason, a relative decrease in forward impedance by increasing the nozzle length behind the heater leads to an increase in impedance of the entire nozzle upon refill, and delays refill (supply) of the ink. Therefore, the above-mentioned technique is discordant with techniques for realizing high-speed operations of recent recording apparatuses.

SUMMARY OF THE INVENTION

It is an object of the present invention to provide an ink jet recording apparatus and method, which can stably eject an ink.

It is another object of the present invention to provide an ink jet recording apparatus, which can suppress high- to low-frequency vibrations of an ink in a common ink chamber.

It is still another object of the present invention to provide an ink jet recording apparatus which can realize high conversion efficiency of input energy without sacrificing ejection reliability, and can realize a high-speed response by decreasing the impedance in a nozzle.

It is still another object of the present invention to provide an ink jet recording apparatus which can improve the backward impedance of a nozzle, can suppress vibrations of an ink, can prolong the suppression duration, and can obtain the suppression effect independently of the nozzle position.

In order to achieve the above objects, according to the present invention, there is provided an ink jet recording apparatus for performing recording on a recording medium by ejecting an ink, comprising:

an ejection orifice for ejecting an ink;

a supply portion, communicating with the ejection orifice, for supplying an ink stored therein to the ejection orifice;

ejection energy producing means, arranged in the supply portion, for applying energy for ink ejection to the ink;

pressure producing means, arranged in the supply portion at a position different from the ejection energy producing means, for producing a pressure wave in the supply portion; and control means for controlling the pressure producing means to produce a pressure wave different from a pressure wave produced in the supply portion by the ejection energy producing means.

According to the present invention, there is also provided an ink jet recording apparatus for performing recording on a recording medium by ejecting an ink, comprising:

an ejection orifice for ejecting an ink;

a supply portion, communicating with the ejection orifice, for supplying an ink stored therein to the ejection orifice;

ejection energy producing means, arranged in the supply portion, for applying energy for ink ejection to the ink;

pressure producing means, arranged in the supply portion at an upstream side, in an ink supply direction, of the ejection energy producing means, for producing a pressurized state in the supply portion; and control means for controlling the pressure producing means to produce the pressurized state at a timing before the ejection energy producing means produces an ejection pressure.

According to the present invention, there is also provided an ink jet recording apparatus for performing recording on a recording medium by ejecting an ink, comprising:

a plurality of ejection orifices for ejecting an ink;

a supply portion for supplying an ink stored therein to the plurality of ejection orifices;

a plurality of ejection energy producing means, arranged in the supply portion in correspondence with the plurality of ejection orifices, for applying energy for ink ejection to the ink;

a plurality of pressure producing means, arranged in the supply portion at an upstream side, in an ink supply direction, of the ejection energy producing means, for producing a pressurized state in the supply portion; and control means for controlling the pressurized states produced by the plurality of pressure producing means.

According to the present invention, there is also provided an ink jet recording method for performing recording on a recording medium by ejecting an ink, comprising the steps of:

providing a recording head comprising: an ejection orifice for ejecting an ink; a supply portion, communicating with the ejection orifice, for supplying an ink stored therein to the ejection orifice; ejection energy producing means, arranged in the supply portion, for applying energy for ink ejection to the ink; and pressure producing means, arranged in the supply portion at an upstream side, in an ink supply direction, of the ejection energy producing means, for producing a pressurized state in the supply portion;

driving the pressure producing means, so that the pressure producing means produces the pressurized state to increase an impedance at the upstream side, in the ink supply direction, of the supply portion; and driving the ejection energy producing means for ink ejection after the pressure producing means is driven.

According to the present invention, there is also provided an ink jet recording method for performing recording on a recording medium by ejecting an ink, comprising the steps of:

providing a recording head comprising: a plurality of ejection orifices for ejecting an ink; a supply portion for supplying an ink stored therein to the plurality of ejection orifices; a plurality of ejection energy producing means, arranged in the supply portion in correspondence with the plurality of ejection orifices, for applying energy for ink ejection to the ink; and a plurality of pressure producing means, arranged in the supply portion at an upstream side, in an ink supply direction, of the ejection energy producing means, for producing a pressurized state in the supply portion;

driving one of the plurality of pressure producing means, so that one of the pressure producing means produces the pressurized state to increase an impedance at the upstream side, in the ink supply direction, of the supply portion;

driving corresponding ones of the plurality of ejection energy producing means for ink ejection after one of the plurality of pressure producing means is driven; and repeating the driving steps of the plurality of pressure producing means and the plurality of ejection energy producing means.

DETAILED DESCRIPTION OF THE PREFERRED EMBODIMENTS

The arrangement of an ink jet recording apparatus applied to the respective embodiments of the present invention will now be described.

Figure 1:
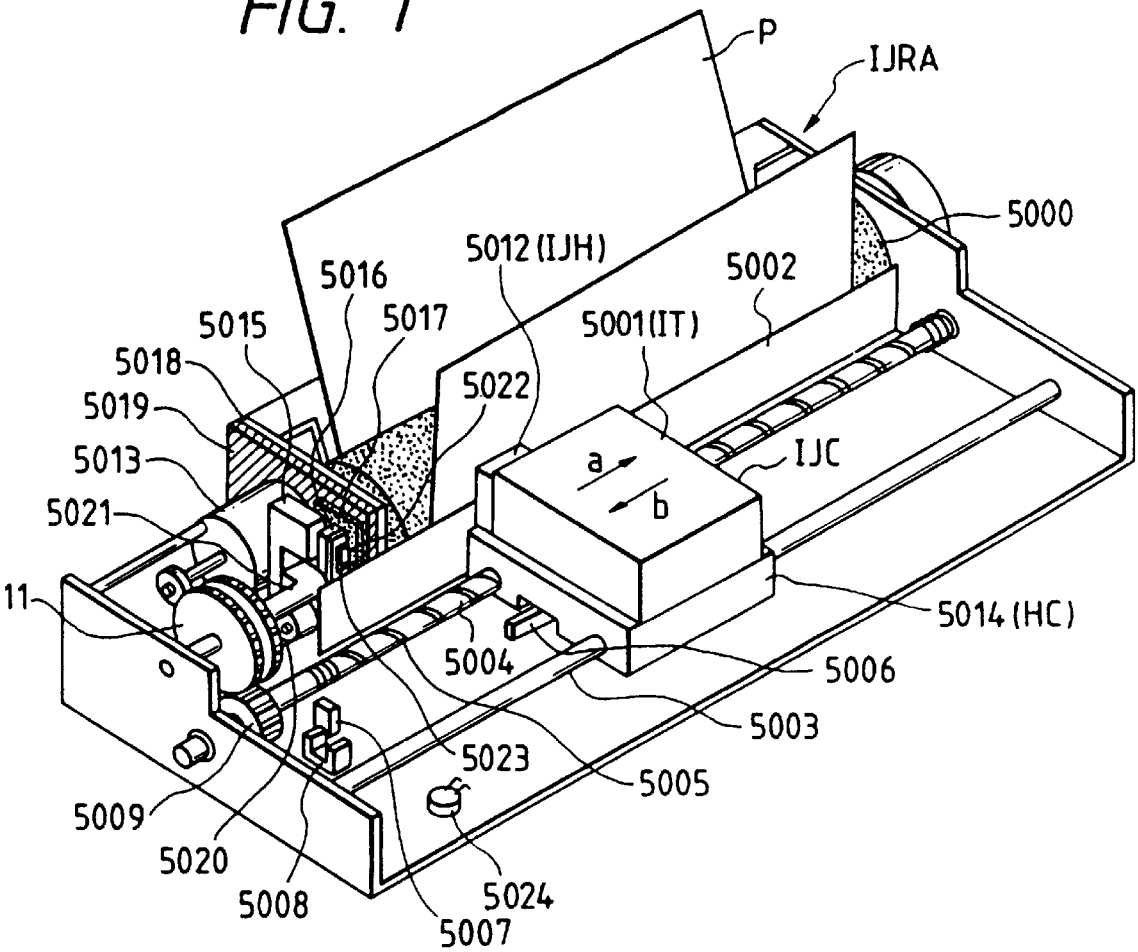
FIG. 1 is a perspective view showing the arrangement of a preferred ink jet recording apparatus in or to which the present invention is practiced or applied.
Figure 2:
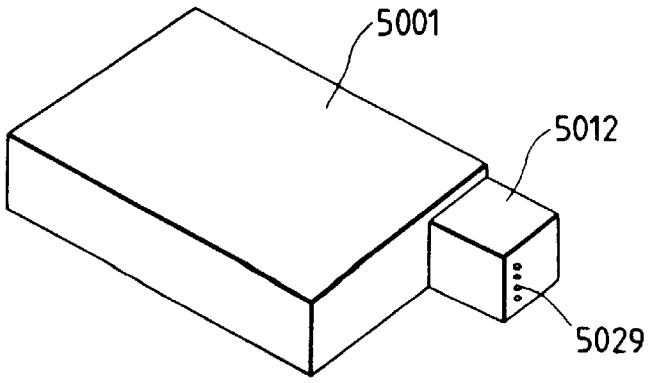
FIG. 2 is a perspective view showing an exchangeable cartridge.

FIG. 1 is a perspective view showing the arrangement of a preferred ink jet recording apparatus IJRA in or to which the present invention is practiced or applied. Referring to FIG. 1, an ink tank (IT) 5001 is coupled to a recording head (IJH) 5012. As shown in FIG. 2, the ink tank 5001 and the recording head 5012 form an exchangeable integrated cartridge (IJC). A carriage (HC) 5014 is used for mounting the cartridge (IJC) on a printer main body, and is scanned in the sub-scanning direction along a guide 5003.

A platen roller 5000 is used for scanning a recording medium P in the main scanning direction. A temperature sensor 5024 measures the environmental temperature in the apparatus. Note that the carriage 5014 is connected to a printed circuit board (not shown) comprising electrical circuits (the above-mentioned temperature sensor 5024, and the like) for controlling the printer via a flexible cable (not shown) for supplying a signal pulse current for driving, a current for head temperature control, and the like to the recording head 5012.

FIG. 2 shows the exchangeable cartridge. The cartridge shown in FIG. 2 has nozzle portions 5029 for ejecting ink droplets. The ink jet recording apparatus IJRA with the above arrangement will be described in more detail below. In this recording apparatus IJRA, the carriage HC engaged with a spiral groove 5004 of a lead screw 5005, which is rotated via driving power transmission gears 5011 and 5009 upon forward/reverse rotation of a driving motor 5013, has a pin (not shown), and is reciprocally moved in the directions of arrows a and b. A paper pressing plate 5002 presses a paper sheet against the platen 5000 across the carriage moving direction. Photocouplers 5007 and 5008 serve as home position detection means for detecting the presence of a lever 5006 of the carriage HC in the corresponding region, and for, e.g., switching the rotational direction of the motor 5013. A member 5016 supports a cap member 5022 for capping the front surface of the recording head, and a suction means 5015 for drawing the interior of the cap by suction performs suction recovery of the recording head 5012 via an intra-cap opening 5023.

A cleaning blade 5017 and a member 5019 for allowing the blade 5017 to be movable in the back-and-forth direction are supported on a main body support plate 5018. The shape of the blade is not limited to this, and a known cleaning blade can also be applied to the present invention, as a matter of course. A lever 5021 is used for initiating a suction operation of the suction recovery. The lever 5021 is moved upon movement of a cam 5020 engaged with the carriage HC, and its movement is controlled by the driving force from the driving motor via a known transmission means such as clutch switching.

These capping, cleaning, and suction recovery mechanisms are designed to perform desired processing at the corresponding positions upon operation of the lead screw 5005 when the carriage HC reaches a home position-side region. However, the present invention is not limited to the above-mentioned mechanisms as along as desired operations are performed at known timings.

Figure 3:
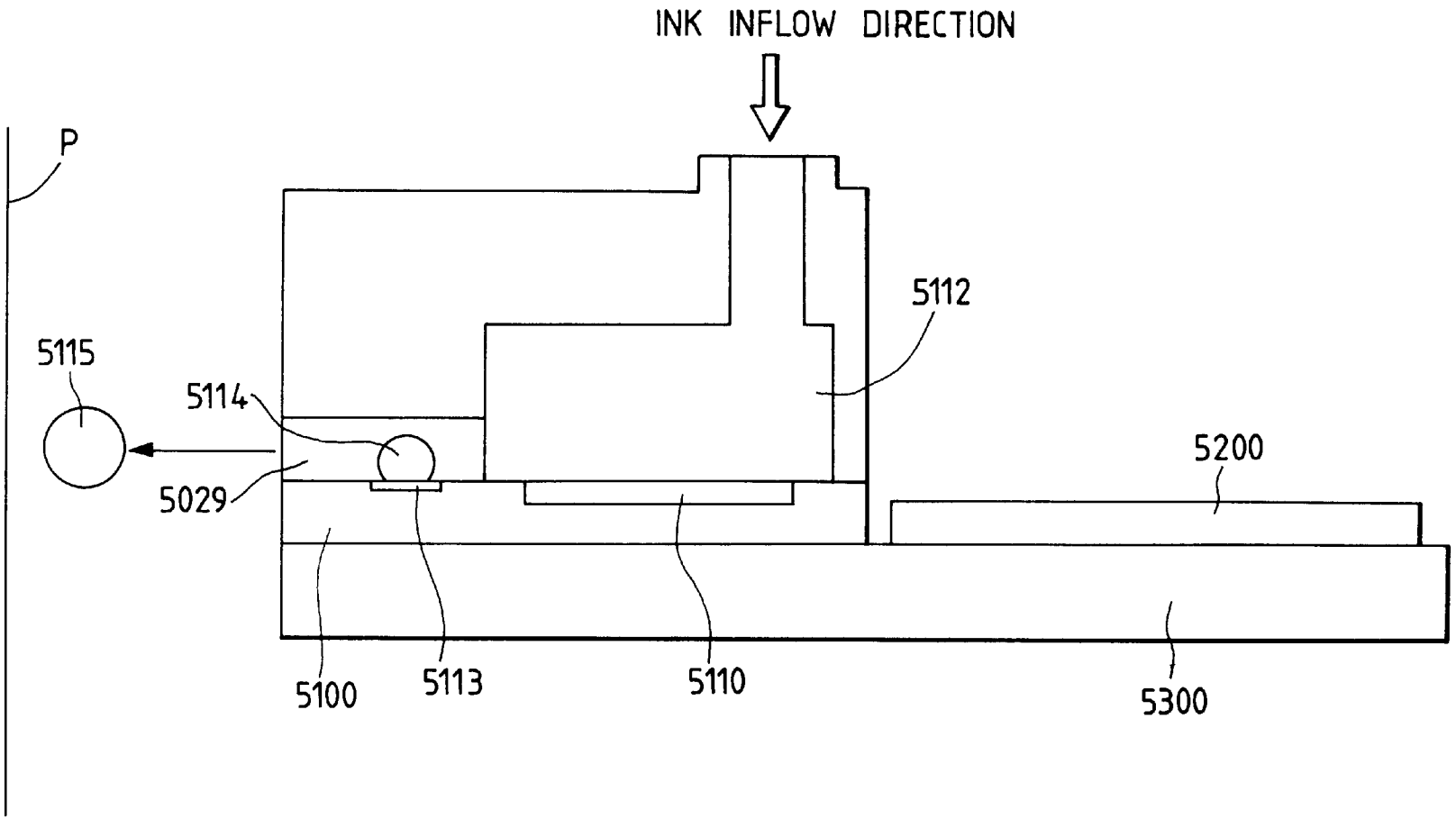
FIG. 3 is an explanatory view showing the sectional structure of a recording head.

FIG. 3 shows the details of the recording head 5012. A heater board 5100 formed by a semiconductor manufacturing process is arranged on the upper surface of a support member 5300. A temperature control heater (temperature raise heater) 5110 for maintaining and controlling the temperature of the recording head 5012 is formed in the same semiconductor manufacturing process on the heater board 5100. A wiring board 5200 is arranged on the support member 5300, and the wiring board 5200, the temperature control heater 5110, ejection (main) heaters 5113, and other signal lines are electrically connected via, e.g., wire bonding patterns (wiring patterns are not shown). The temperature control heater 5110 may be prepared by adhering a heater member formed in a process different from that of the heater board 5110 on, e.g., the support member 5300.

A bubble 5114 is produced by heating an ink by the ejection heater 5113, and an ink droplet 5115 is ejected by the bubble. The ink to be ejected flows from a common ink chamber 5112 into the recording head.

(Description of Control Arrangement)

Figure 5:
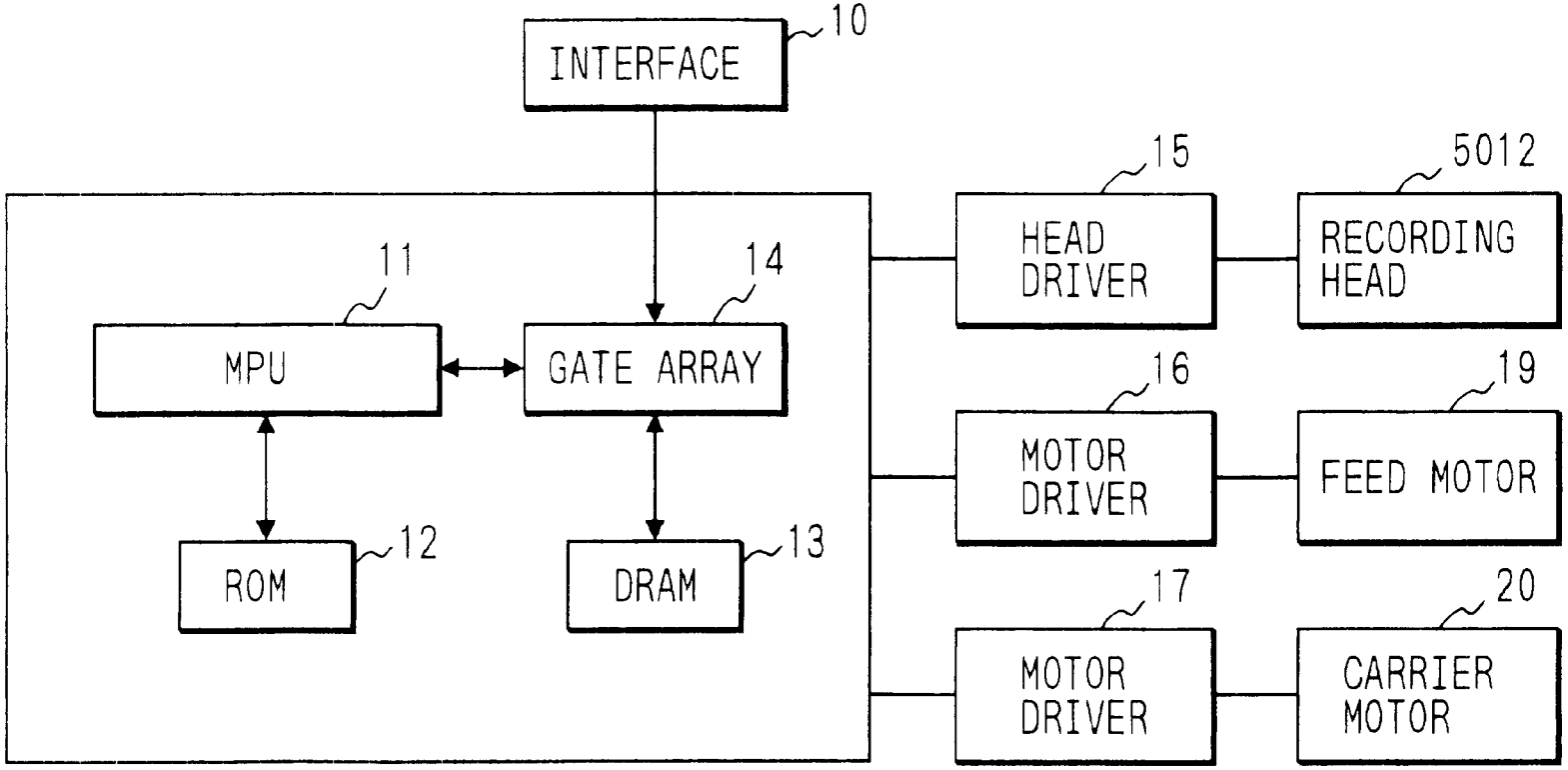
FIG. 5 is a schematic block diagram of the control circuit.

The control arrangement for executing recording control of the respective units of the above-mentioned apparatus arrangement will be described below with reference to the block diagram shown in FIG. 5. Referring to FIG. 5, a control circuit includes an interface 10 for receiving a recording signal, an MPU 11, a program ROM 12 for storing a control program to be executed by the MPU 11, a dynamic RAM 13 for storing various data (the above-mentioned recording signal, recording data supplied to the head, and the like), a gate array 14 for performing supply control of recording data to a recording head 18, and also performing transfer control of data among the interface 10, the MPU 11, and the RAM 13, a carrier motor 20 for driving the recording head 18, a feed motor 19 for feeding a recording paper sheet, a head driver 15 for driving the head, and motor drivers 16 and 17 for respectively driving the feed motor 19 and the carrier motor 20.

Figure 4:
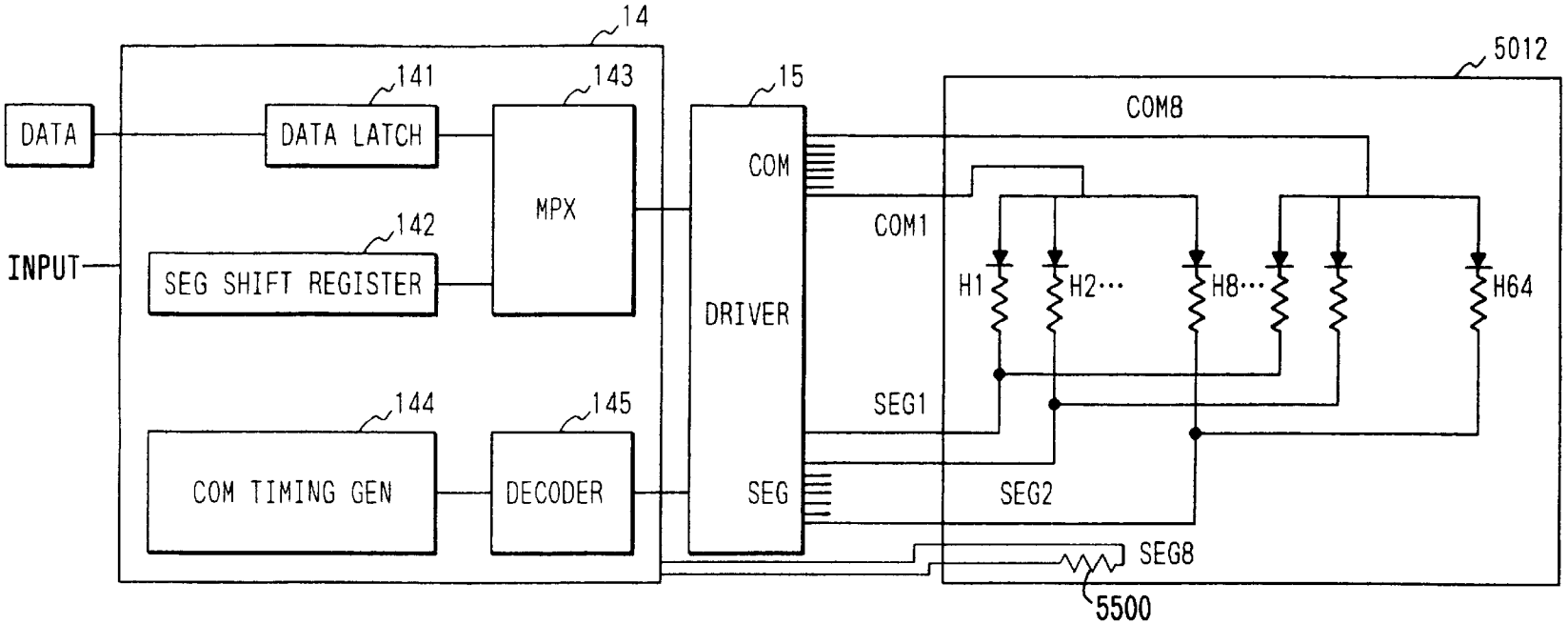
FIG. 4 is a schematic block diagram of a control circuit.

FIG. 4 is a circuit diagram showing the details of the respective units in FIG. 5. The gate array 14 comprises a data latch 141, a segment (SEG) shift register 142, a multiplexer (MPX) 143, a common (COM) timing generator 144, and a decoder 145. The recording head 18 adopts a diode-matrix arrangement. That is, a driving current is supplied to an ejection heater (H1 to H64) corresponding to a position where a common signal COM and a segment signal SEG coincide with each other, thereby heating and ejecting an ink.

The decoder 145 decodes a timing generated by the common timing generator 144, and selects one of common signals COM1 to COM8. The data latch 141 latches recording data read out from the RAM 13 in units of 8 bits, and outputs the latched recording data as segment signals SEG1 to SEG8 in accordance with the segment shift register 142. The output from the multiplexer 143 can be variously changed according to the content of the shift register 142 like an output in units of bits, an output in units of 2 bits, an output of all 8 bits, and the like.

The operation of the control arrangement will be described below. When a recording signal is input to the interface 10, the recording signal is converted into recording data for printing between the gate array 14 and the MPU 11. The motor drivers 16 and 17 are driven, and the recording head is driven in accordance with the recording data supplied to the head driver 15, thus performing a print operation.

(First Embodiment)

Figure 6:
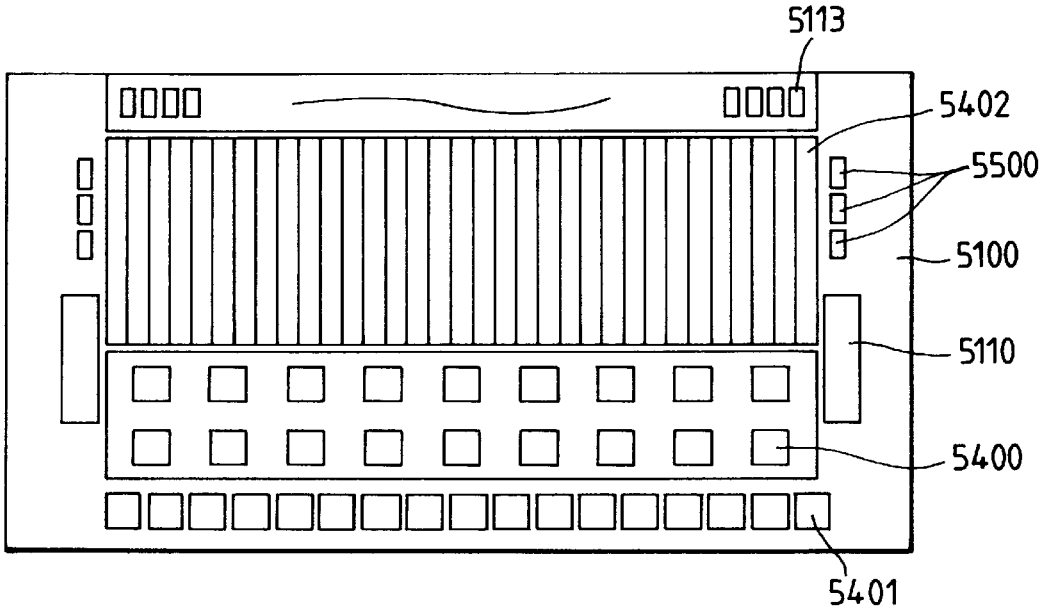
FIG. 6 is an explanatory view of a heater board in the recording head used in the present invention.

FIG. 6 is a detailed plan view of the heater board 5100 used in this embodiment. Meniscus control heaters (to be referred to as MC heaters hereinafter) 5500, diodes 5400 for the diode matrix, wire bonding pads 5401, and wiring patterns 5402 to the ejection heaters 5113 are formed on the heater board 5100.

Figure 7:
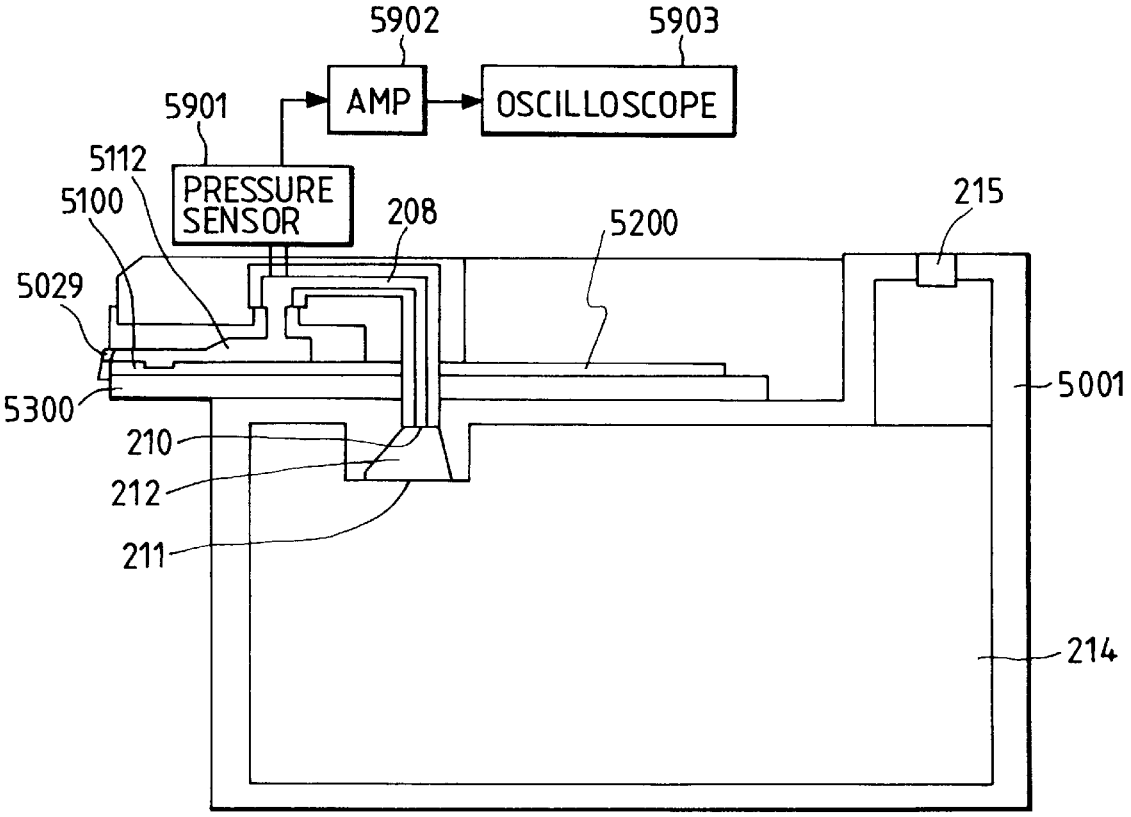
FIG. 7 is an explanatory view of a test apparatus for explaining the present invention.

FIG. 7 shows the arrangement of a measurement system for testing the vibration suppression effect of the present invention. A pressure sensor 5901 is connected to a channel in the recording head, so that a vibration produced in the common ink chamber can be experimentally monitored by an oscilloscope 5903 via an amplifier 5902. The recording head includes an ink channel 208, a first filter 210, a second filter 211, an ink channel 212 formed between the filters, and a sponge 214 arranged in the ink tank, and filled with an ink. The interior of the ink tank communicates with the air via an air communication port 215.

Figure 8A:
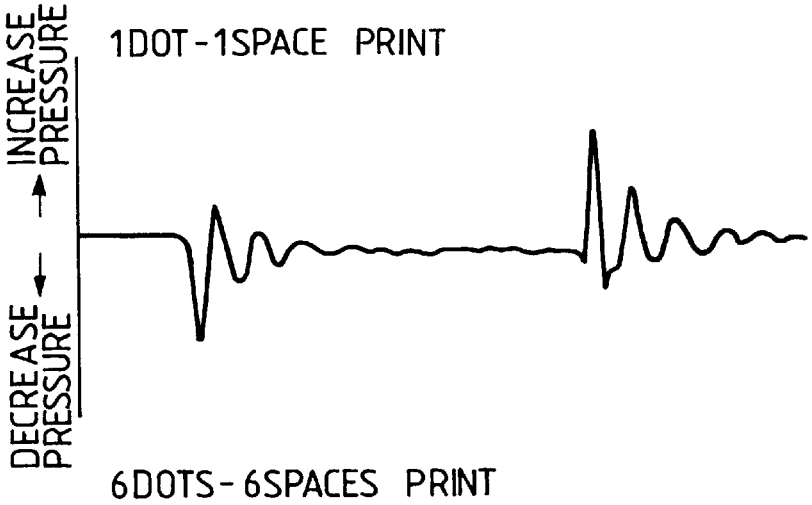
FIGS. 8A to 8C are graphs showing the measurement results of vibrations in the recording head measured by the test apparatus shown in FIG. 7.
Figure 8B:
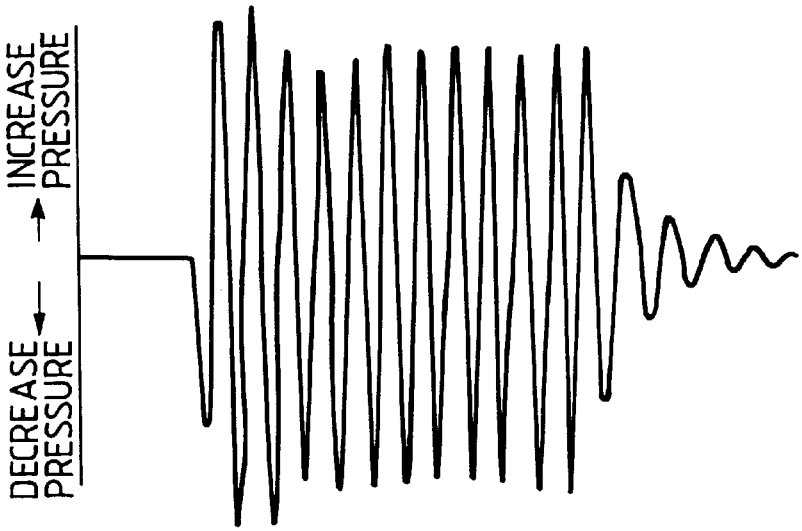
Figure 8C:
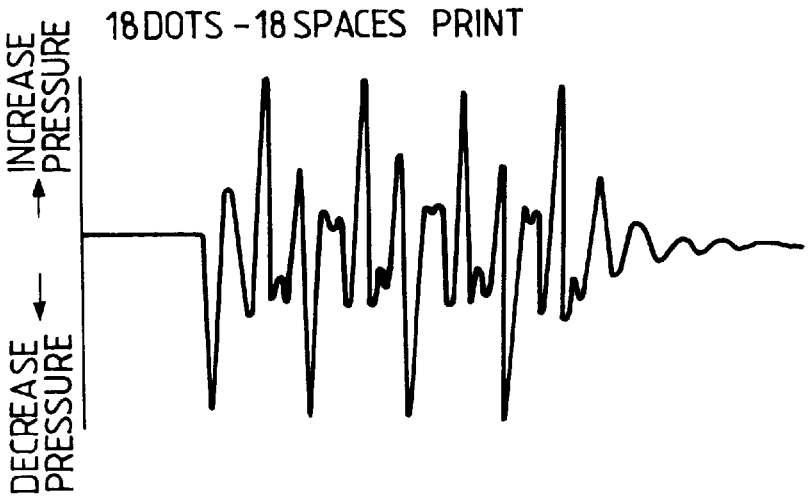
Figure 9:
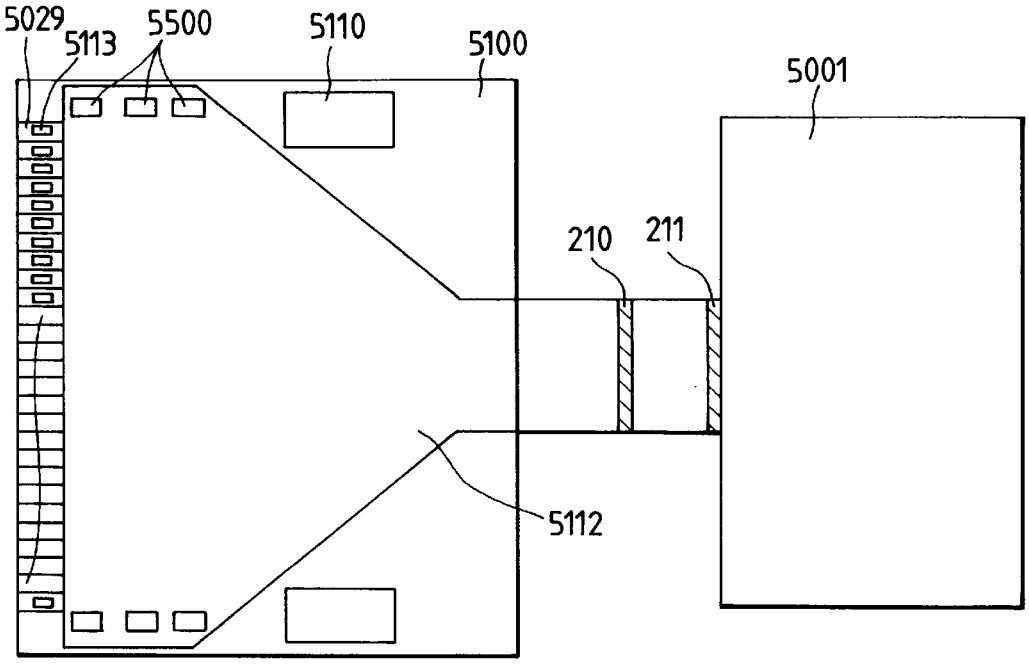
FIG. 9 is a view showing the positional relationship between the arrangement of ink channels and heaters in an ink jet cartridge for explaining the present invention.
Figure 10A:
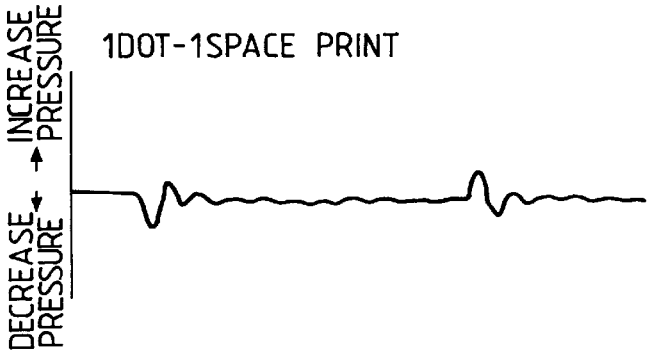
FIGS. 10A and 10B are graphs showing the vibration suppression effect obtained by the control of the present invention.
Figure 10B:
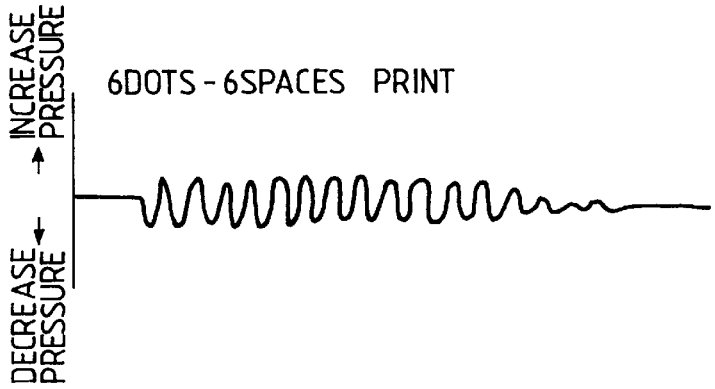
Figure 11A:
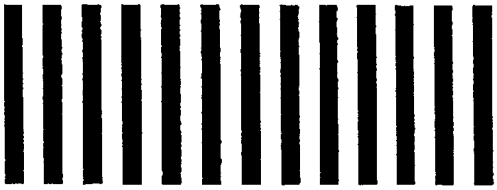
FIGS. 11A to 11C are views showing examples of bar code patterns used in evaluation of the present invention.
Figure 11B:
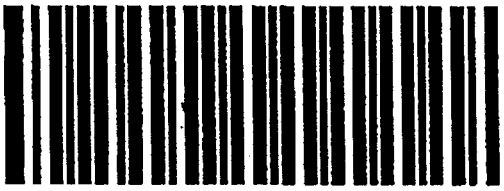
Figure 11C:
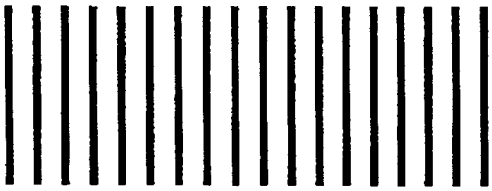
Figure 12A:
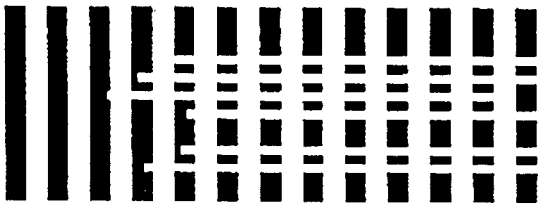
FIGS. 12A to 12C are views showing examples of print defects obtained in the prior art by using the bar code patterns used in evaluation of the present invention.
Figure 12B:
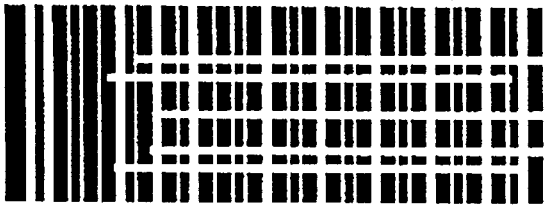
Figure 12C:
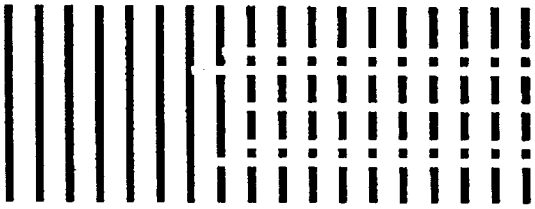

FIGS. 8A to 8C show waveforms obtained by measuring a vibration state using the vibration measurement system shown in FIG. 7. FIG. 9 shows the relationship among the ink channels, the ink tank, and the heater board of the ink jet recording head. FIGS. 10A and 10B show suppression states of a low-frequency vibration obtained by the control of the present invention. FIGS. 11A to 11C show print samples according to the present invention, and FIGS. 12A to 12C show print samples according to the prior art.

A case will be examined below with reference to FIGS. 11A to 11C wherein bar code print patterns including many dots and spaces are printed. In this case, since the refill frequency of the nozzles of the recording head is sufficient, a print operation must be performed without posing any problems. However, as shown in FIGS. 12A to 12C, print errors start to occur in the middle of the print operation, and ink non-ejected portions are formed.

Figure 13A:
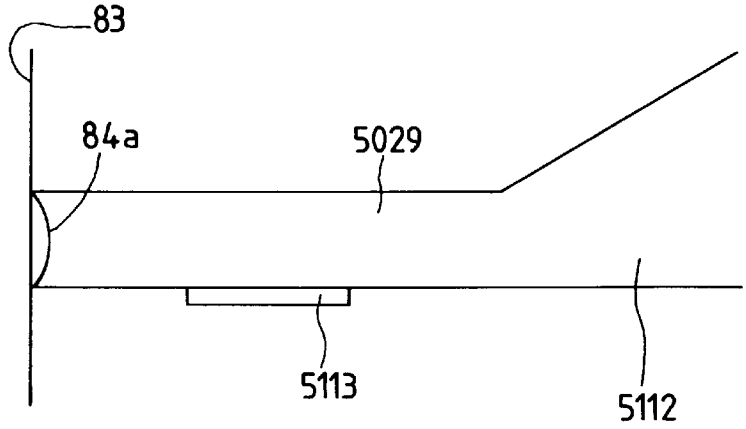
FIGS. 13A to 13C are views for explaining the states of a meniscus formed by a vibration.
Figure 13B:
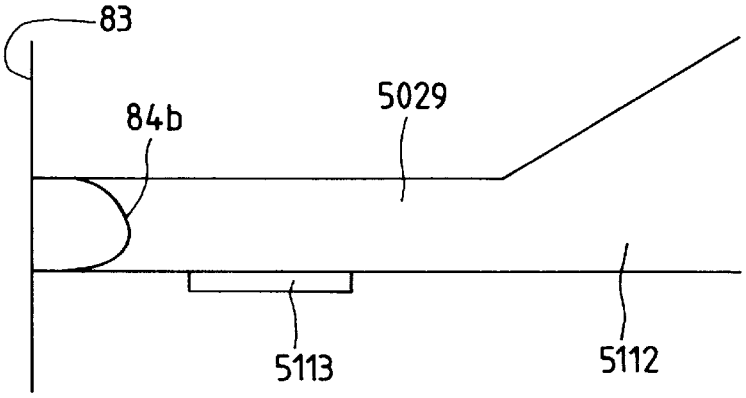
Figure 13C:
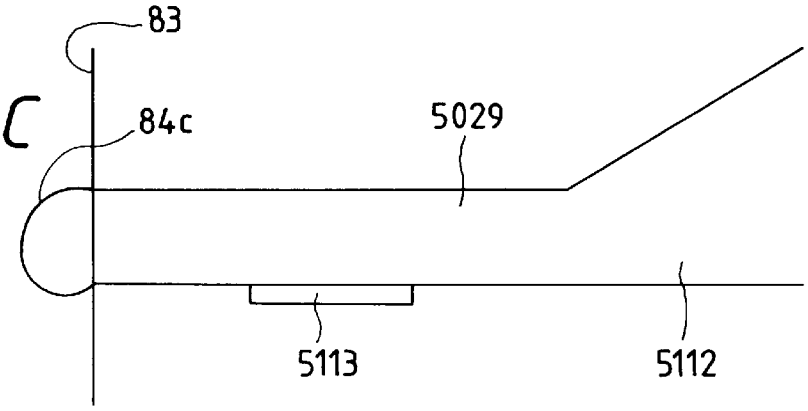

Upon observation of this phenomenon using the measurement system shown in FIG. 7, the following state was found. Upon observation of the state of a meniscus of an ink in a print nozzle at that time, the meniscus is in a state, as shown in FIGS. 13A to 13C. In FIG. 13A, a meniscus 84 a in a normal state is formed. However, FIG. 13B shows a state wherein a meniscus 84 b excessively recedes due to a vibration. Furthermore, FIG. 13C shows a state wherein a meniscus 84C projects from a face 83.

In the common ink chamber, some vibration modes are mixed. When a vibration mode having the longest period and a large amplitude of these modes coincides with the ejection period of the bar code print pattern, a resonance state occurs. As a result, a large resonance pressure is produced, and disturbs the meniscus shape in a nozzle and refill itself to cause irregular foaming, resulting in an ejection amount decreased state or a non-ejection state (to be referred to as an ejection error state hereinafter).

Vibration producing modes are roughly classified into the following three modes. One mode is a vibration of high frequency level, which is produced as a reactive pressure wave of ejection. Another mode is a vibration of middle frequency level, which is produced when an ink is refilled in a nozzle. The frequency of this vibration is basically determined by the ink physical properties and the impedance design of the nozzle shape.

The last mode is a vibration of the lowest frequency. The frequency of this vibration is determined by the total impedance of the ink tank and the ink channels, the common ink chamber, and the nozzles in the recording head. An ejection error occurs due to one of or a combination of these vibration modes.

For example, when the head is driven in units of 8-nozzle blocks, a print defect such as an ejection error, a change in dot size, or the like sometimes occurs between two adjacent blocks. This print defect occurs due to an interference between the two adjacent blocks caused by a vibration of the highest frequency as a reactive pressure wave of ejection. When a 2-dot vertical ruled line is printed, some dots in the print line at the second dot position cause a print defect. This print defect is mainly caused by a vibration of middle frequency level produced by the refill characteristics of nozzles.

When the driving frequency of a certain recording head is variously changed, the ejection amount often decreases at a specific frequency. This phenomenon is also mainly caused by a vibration of middle frequency level produced by the refill characteristics of nozzles. In these cases, since the amplitude of a vibration upon refill is large, a print defect occurs due to the excessively backward or forward position of the meniscus, as shown in FIGS. 13B and 13C.

Finally, when a specific bar code pattern is printed, as described above, a print defect occurs in some cases. This print defect occurs due to a vibration of the lowest frequency including a tank system.

As for the vibrations of the highest frequency and the middle frequency of the above-mentioned vibrations, some prevention methods have been proposed. As for the vibration of the lowest frequency, a method of forming an air reservoir in the tank is adopted, and there is no method of preventing the vibration by a recording head control method. Although the method of preventing the vibration by, e.g., the air reservoir is effective, problems of stability, duration, and other adverse effects due to a change in temperature, aging, and the like are often posed.

The present invention has as its object to actively suppress a vibration by control so as to prevent an unstable state caused by the above-mentioned passive vibration absorption element.

Furthermore, according to the present invention, all vibrations including those of the high and middle frequencies can be simultaneously absorbed.

A control method of the present invention will be described below with reference to a model shown in FIG. 9. The MC heaters 5500 are arranged in the common ink chamber, and a resonance pressure is prevented from being produced by driving the MC heaters 5500 with a value shifted from all resonance frequencies and phases. In the first embodiment, a control method for suppressing a vibration in the lowest frequency range including a tank system will be described below.

FIGS. 8A to 8C show conventional resonance states of a pressure produced in the common ink chamber and measured using the pressure measurement system shown in FIG. 7 when a vertical line for 64 nozzles is printed by repetitively printing N dots-N spaces patterns using a 64-nozzle head.

The case of a 1 dot-1 space print operation (FIG. 8A) will be described below. At the beginning of the print operation, movement of an ink is delayed by the inertial mass including the overall movement of the ink in the ink tank, and an abrupt negative pressure state occurs for about a time corresponding to 3-dot columns. When the pressure has reached a maximum negative pressure state in about 0.5 msec (for 3-dot columns), movement of the ink from the ink tank begins, and the negative pressure is immediately canceled. Thereafter, an attenuated vibration is repeated a few times at a vibration period of about 2 msec, and a constant negative pressure state is finally reached. During the print operation, since the forcible vibration frequency of the ink by an ejection pattern is higher than the natural frequency of the tank system, and is lower than the frequencies of other vibrations, resonance does not take place. Therefore, in a low-frequency vibration range, a constant negative pressure state continues. At an instance when the print operation ends, a force for moving the ink forward continues to act by the inertia for moving the ink, and the pressure in the common ink chamber immediately increases. At this time, the pressure state also converges while repeating an attenuated vibration at a vibration period of about 2 msec.

The case of a 6 dots-6 spaces print operation (FIG. 8B) will be examined below. In this case, at the beginning of the print operation, 6-dot columns are continuously printed. At this instance, an abrupt negative pressure is generated. Since the amount of ink ejected in 0.5 msec is larger than that in the 1 dot-1 space print operation, the amplitude of the negative pressure also becomes larger than that in the 1 dot-1 space print operation. Then, the negative pressure is immediately canceled after an elapse of 0.5 msec. When about 1 msec elapses, ejection is interrupted, and the print operation is restarted after an elapse of about 1 msec therefrom. This timing just coincides with the natural frequency period of the lowest-frequency vibration including the ink tank, and is in phase with production of the negative pressure for the above-mentioned reason when the next 6-dot ejection is started. For this reason, a resonance state in which the vibration is never attenuated is started. When the print operation ends, the pressure converges while repeating an attenuated vibration.

FIG. 8C shows the case of an 18 dots-18 spaces print operation. A large vibration is produced immediately after the beginning of the 18-dot print operation and immediately after the end of the print operation. However, since no resonance state basically occurs, the vibration does not cause any larger pressure variation. Upon observation of the print results in these pressure states, it was found that only the 6 dots-6 spaces print operation causes a print error from the middle of the print operation, as shown in FIG. 12B.

The method of the present invention will be described below. In the method of the present invention, the MC heaters 5500 are driven to form a bubble in the common ink chamber, thereby attenuating a natural vibration of a low frequency. As the method of attenuating the vibration, the following three methods have been proposed.

In the first method, a bubble is equivalently present only when required, by driving the MC heaters at a high frequency at a required timing, so that the bubble is used as a pressure absorbing member. In the second method, the MC heaters are driven at a required timing at a period equivalently different from that of a tank vibration so as to produce a vibration by a pressure wave, so that the produced vibration does not easily resonate with the vibration of the tank system at a low frequency. In the third method, a bubble is formed at a high frequency at a required timing, i.e., a timing at which several tens of % of the ink volume decreased by ejection are volume-compensated, thereby decreasing the amplitude of the vibration. This bubble is free from a problem of the refill frequency of the nozzle unlike one formed inside the nozzle. For this reason, since the bubble can be formed simply in a time period between foaming and collapsing timings, it can be formed at a high frequency.

As the first method, a case will be described below wherein a bubble is used as a pressure absorbing member which is present only when required. As can be seen from the above description, timings at which the low-frequency vibration of the tank system must be attenuated correspond to the negative pressure direction at the beginning of the print operation, and the positive pressure direction at the end of the print operation. A bubble is formed at a high frequency according to these timings to assure the presence of a bubble as a pressure absorbing member. As shown in the timing chart in FIG. 14, control of the MC heaters 5500 is started to have, as a start point, a timing at which a change in number of print dots is large. In this embodiment, the duration of the control is about 5 msec. When another timing corresponding to a large change width appears within 5 msec, the control duration is extended by another 5 msec from this timing.

Figure 14:
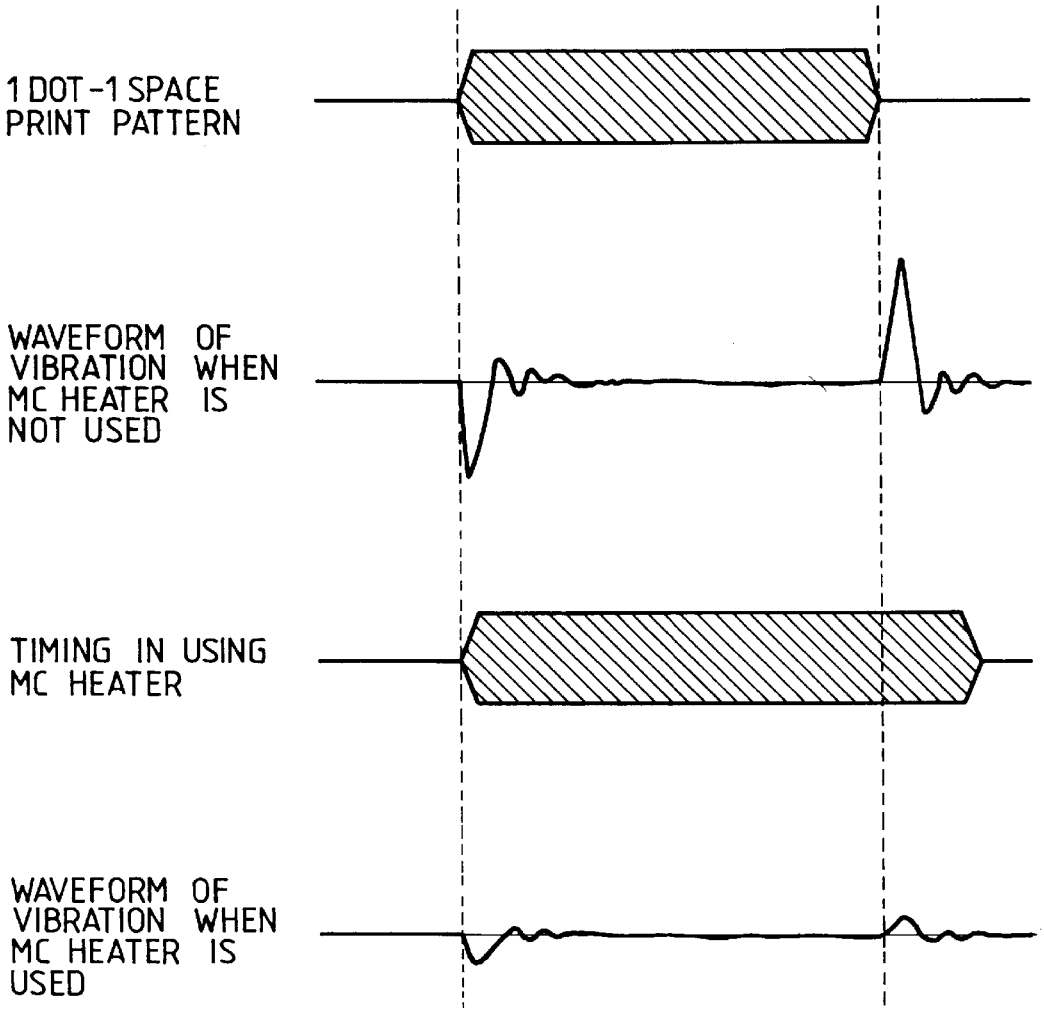
FIG. 14 is a timing chart showing the relationship between the low-frequency vibration and the driving timing of an MC heater according to the first embodiment of the present invention.
Figure 15:
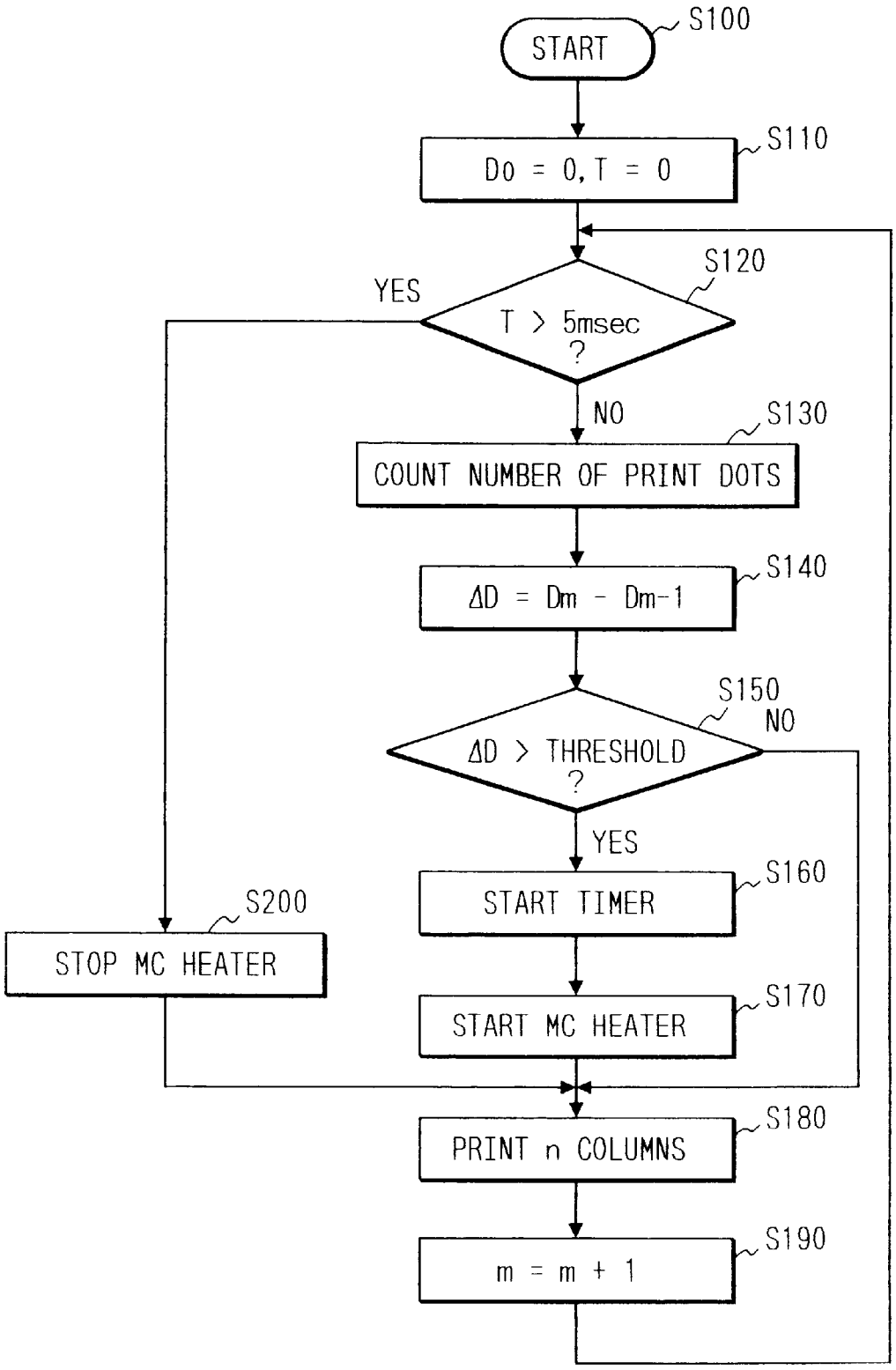
FIG. 15 is a flow chart showing an operation according to the first embodiment of the present invention.

FIG. 15 is a flow chart showing the control. When the change width of the number of print dots is small, since the change width of the pressure is also small, the control of this embodiment need not be performed. Basically, even if the MC heaters are driven all the time, no problem is posed in principle as long as thermal and electrical margins are sufficient. In FIG. 14, the 1 dot-1 space print operation is exemplified, and the same applies to other cases. When the MC heaters 5500 are used, a vibration is absorbed, and its amplitude is decreased.

The control will be described below with reference to the flow chart in FIG. 15. When the flow starts in step S100, Dm (in this case, D0) as a variable indicating the amount of change in the number of print dots and the time of a timer T for controlling the duration of the MC heater control are initialized to 0 in step S110. In step S120, the value of the timer T is checked. At this time, since the control is not started, the timer value is 0, and NO is determined in step S120. In step S130, the number of dots in the number of columns determined as a discrimination range of the control is counted. In this case, the number of columns is one. In step S140, the absolute value of a deviation ΔD from the number of dots one column before is calculated. In step S150, it is checked if this deviation exceeds a threshold beyond which the control is required. If the deviation exceeds the threshold, a trigger signal for starting the timer for controlling the MC heaters 5500 is generated in step S160, and a trigger signal for starting the MC heaters 5500 is generated in step S170, thereby actually starting the control. In step S180, one column is printed, and in step S190, the content of a count-up counter is updated, thus repeating this control.

If it is determined in step S120 that the timer value has reached 5 msec, the flow advances to step S200 to reset the operation of the MC heaters 550, and thereafter, the print operation is continued. In practice, when the 1 dot-1 space print operation is performed in the case of FIG. 14, since the trigger signal for the timer T is generated every two columns (about 0.3 msec) in step S160, the control continues during the print operation, as shown in FIG. 14.

Figure 16:
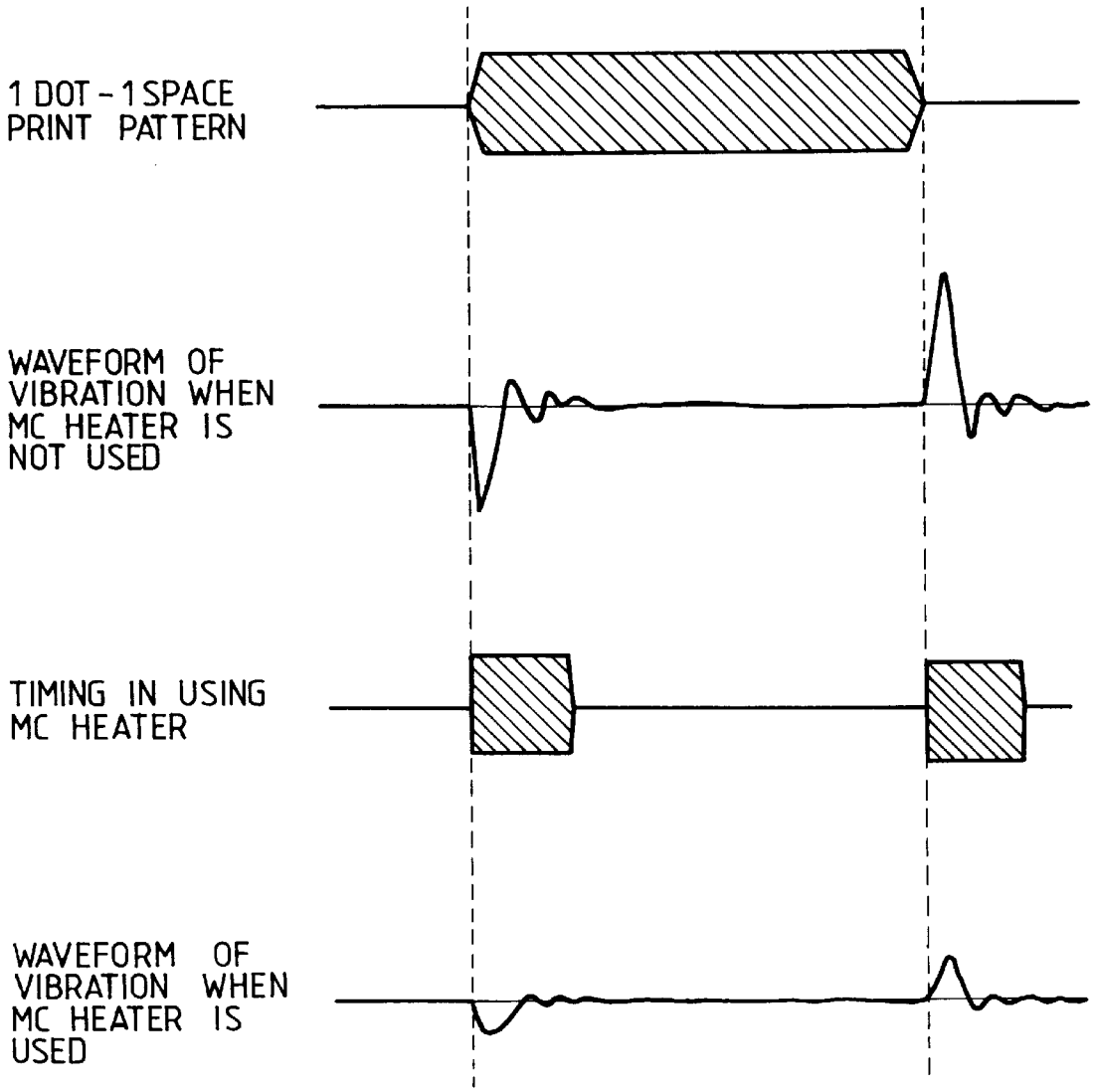
FIG. 16 is a timing chart showing the relationship between the low-frequency vibration and another driving timing of the MC heater according to the first embodiment of the present invention.
Figure 17:
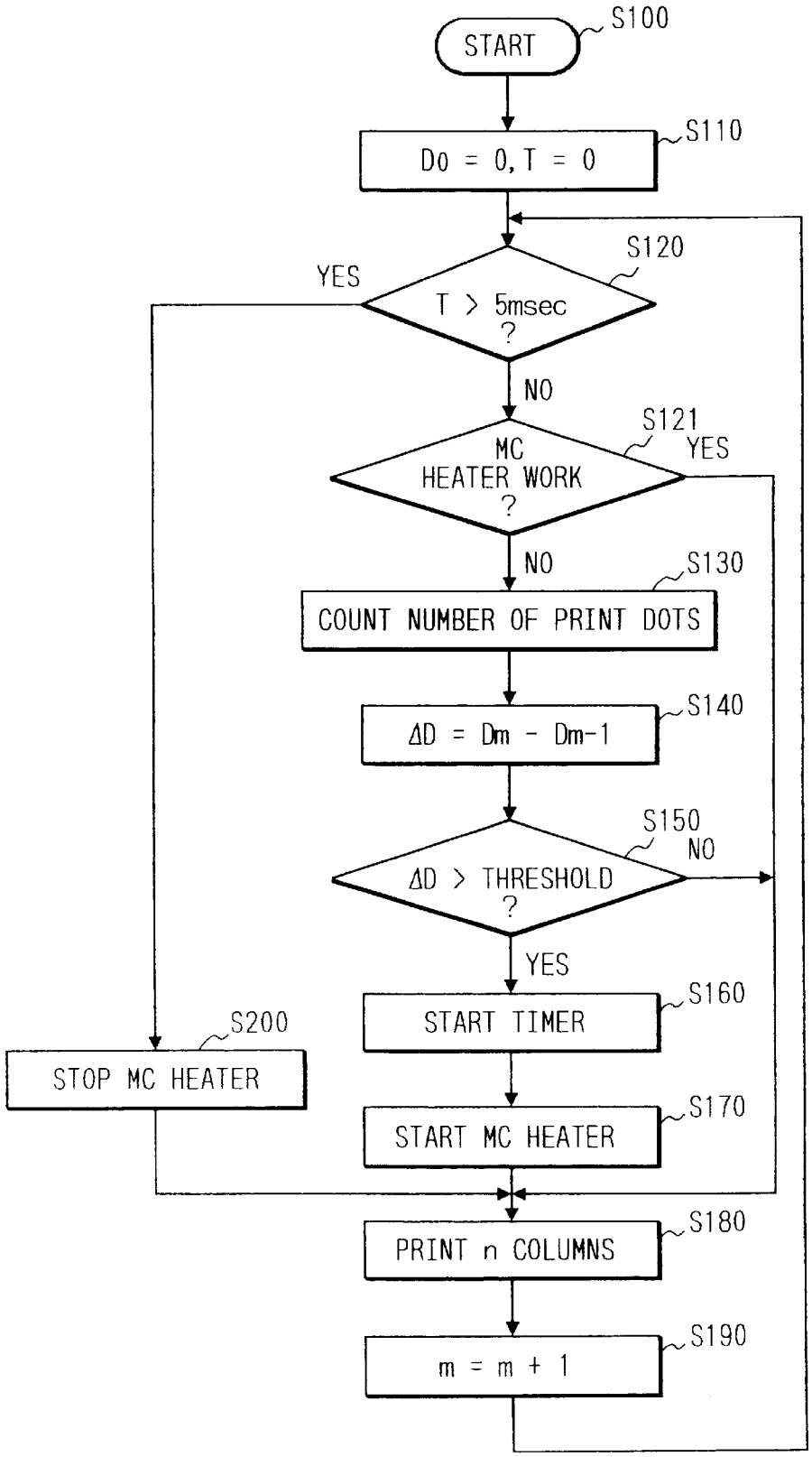
FIG. 17 is a flow chart showing another operation according to the first embodiment of the present invention.

FIG. 16 shows a method which is effective when problems of heat accumulation and power consumption are posed in the above-mentioned embodiment if control is continued when it is not required. As can be seen from FIG. 16, the control is stopped when it is not required. As shown in the flow chart in FIG. 17, the MC heater operation checking step S121 is added. During an operation, update of the content of the timer T (step S160 ) is not performed. As the basic operation of the MC heaters 5500, the MC heaters are continuously driven at a frequency equal to or higher than the ejection frequency.

(Second Embodiment)

In the first embodiment, the method of simply absorbing vibration energy has been described. In the second embodiment, a method which additionally considers the phase of a vibration will be described.

Since a bubble formed by the MC heaters 5500 does not cause actual ink ejection, movement of a large ink volume does not occur, and an ink is moved by a volume corresponding to the volume of the bubble. A pressure wave is processed as an average value of an increase in volume driven at a high frequency. Therefore, at an instance when the MC heaters 5500 begin to be driven by a plurality of pulses, and at an instance of the end of the driving operation by the plurality of pulses, a vibration of low-frequency level as a natural vibration of the head appears. Therefore, although the driving operation of the MC heaters is started at the beginning of the print operation in the same manner as in the first embodiment, the driving operation of the MC heaters is also started immediately before the end of the print operation in place of a timing corresponding to the end of the print operation, so that the driving operation of the MC heaters is started at a timing at which the phase of the natural vibration produced by the vibration is opposite to that of a pressure at the end of the print operation. With this method, the MC heaters 5500 can always be driven in a phase in a direction to cancel the low-frequency natural vibration produced upon starting or stopping ejection.

Figure 18:
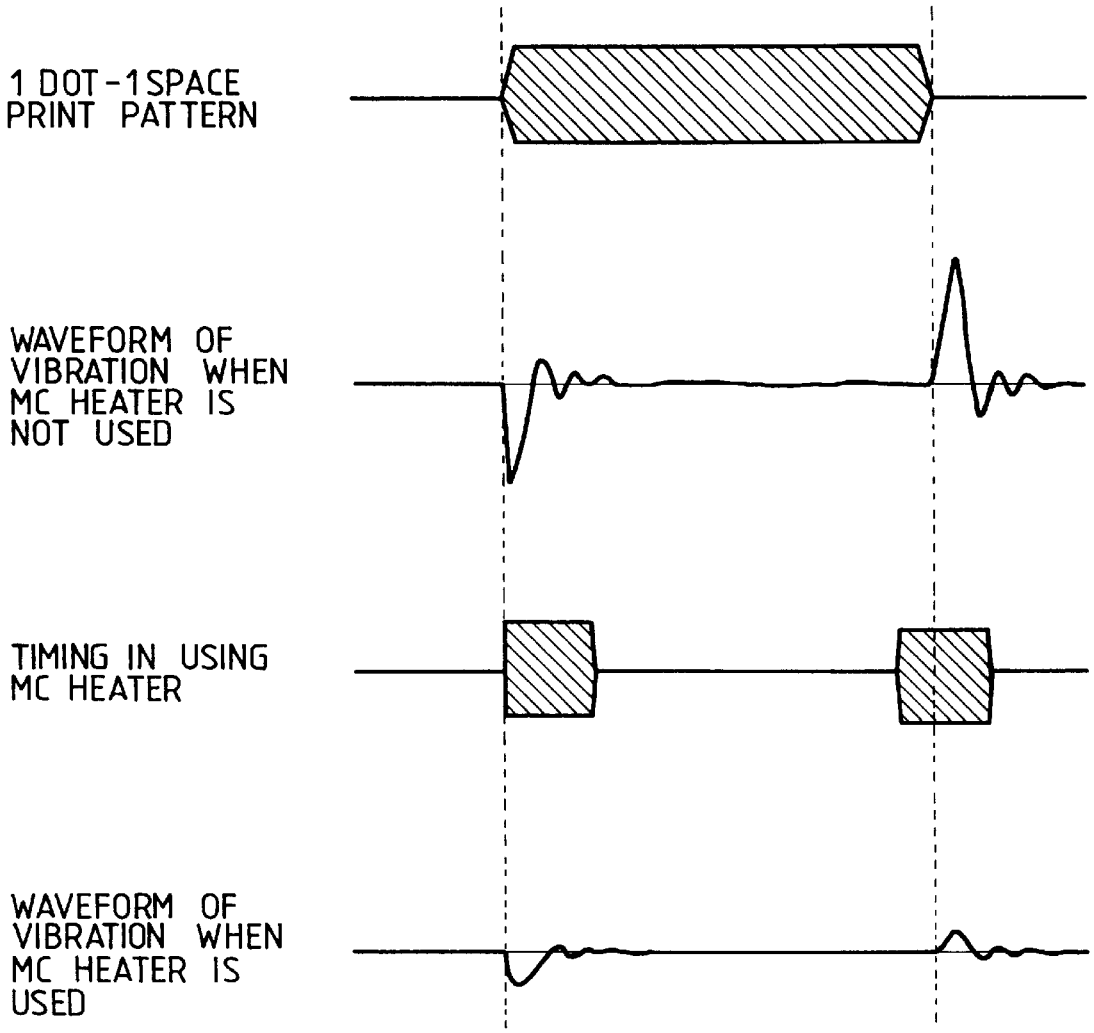
FIG. 18 is a timing chart showing the relationship between the low-frequency vibration and another driving timing of the MC heater according to the second embodiment of the present invention.

FIG. 18 shows the control timing. At the stop of ejection, the MC heaters are driven at a timing before the stop of ejection, and are continuously driven for several msec after the stop of ejection. Thus, the method of this embodiment is very effective since the vibration absorption effect of the first embodiment can be continuously obtained. Furthermore, by intermittently driving the MC heaters 5500 in correspondence with the phase of the natural vibration of the ink tank at both the print start timing and the print end timing, phases can be adjusted up to those of waves of even the second and third periods of the natural vibration, thereby enhancing the vibration suppression effect.

Figure 19:
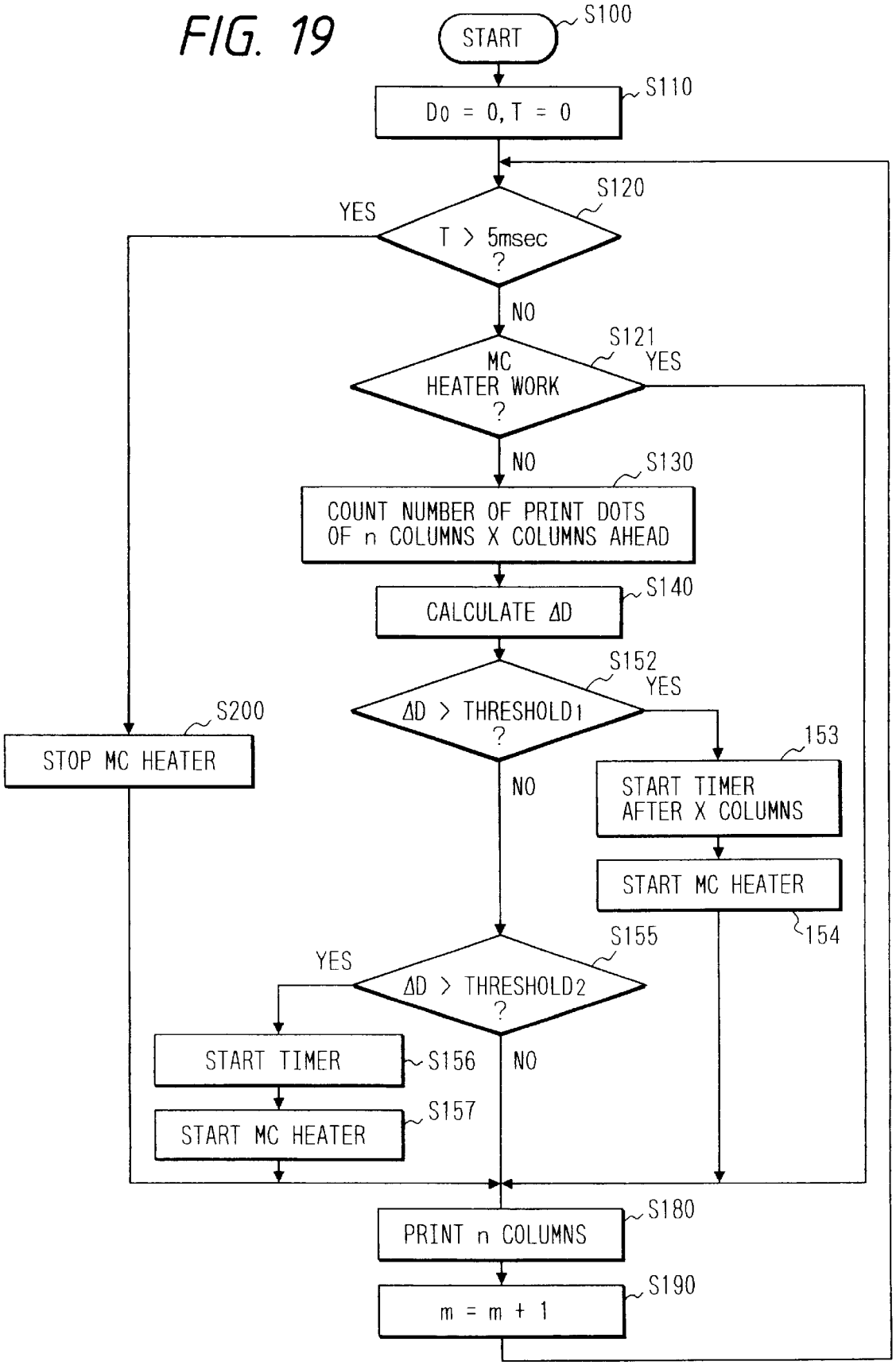
FIG. 19 is a flow chart of the second embodiment of the present invention.

FIG. 19 is a flow chart of the control of the second embodiment. In this embodiment, the number of dots in n columns X columns ahead must be calculated in step S130. In the printer, upon development of dots on a print image buffer, dots several lines ahead have already been developed. For this reason, such lookahead control can be sufficiently performed in terms of the arrangement of the printer. In step S140, ΔD is calculated. If it is determined in step S152 that ΔD largely increases from threshold 1 in a direction to increase the number of dots, the flow advances to steps S153 and S154. In step S153, the MC heater control timer T is set to start after X columns. When the timer T is started after X columns in step S154, the control is started just at the same timing as in the first embodiment. To summarize, since the control waits for a time corresponding to lookahead columns, a shift in timing is prevented.

Conversely, if it is determined in step S155 that ΔD largely changes from threshold 2 in a direction to decrease the number of print dots, the flow advances to step S156, and a trigger signal of the MC heater control timer T is generated at that timing. In step S157, an MC heater start trigger signal is generated to start the control. Thus, the control can be started X columns before a timing at which the number of print dots actually decreases, as shown in FIG. 18. In practice, when the number of columns corresponding to a time half the low-frequency vibration is designated as the time corresponding to X columns, an opposite-phase pressure wave can be generated at the timing of the actually produced low-frequency vibration. In this case, as the driving waveform of the MC heaters 5500, the heaters can be driven at a frequency equal to or higher than the ejection frequency. Furthermore, in another driving method, the MC heaters may be driven by a group of several pulses at the period of the low-frequency vibration, so that the phase is intermittently shifted.

(Third Embodiment)

In each of the above embodiments, the control is executed based on the concept of absorbing or canceling vibration energy. In this embodiment, the MC heaters are driven in correspondence with the ejection amount of an ink so as to compensate for the volume of the ink to some extent in correspondence with a vibration, thereby preventing an abrupt change in pressure in the common ink chamber. With this control, since the amplitude of the vibration can be suppressed to be small, the resonance level can be controlled to be very mall. The driving timing is as shown in FIG. 18.

In the present invention, the MC heaters can be given in correspondence with a variation pattern of the volume. Basically, suppression of an abrupt pressure variation is the first concept in this embodiment. For example, when the ink volume decreases, the driving timing of the MC heaters can be changed in correspondence with a decrease curve of the ink volume so as to compensate for the decreased volume. In this case as well, a space produced for compensating for the volume absorbs the vibration, and exhibits the vibration suppression effect by the vibration absorption effect. In this sense, a bubble space may always be assured, and when a still larger change occurs, the size of the bubble space may be changed in correspondence with the change. As the method of changing the volume of the bubble space, the number of heaters to be driven at the same time may be changed, or the volume of the bubble itself may be changed by changing, e.g., the width of a control pulse.

(Fourth Embodiment)

In the first to third embodiments, absorption of the low-frequency vibration of a system including the tank system, in particular, solutions of problems posed by resonance between the natural vibration and ejection upon printing of a bar code pattern, have been mainly described. In this embodiment, a method of suppressing a vibration in a high-frequency range will be described. When the control of this embodiment is continuously combined with the low-frequency vibration suppression control in the first to third embodiments described above, vibrations from a low-frequency range can be continuously suppressed.

More specifically, the control of this embodiment is achieved as follows. That is, when the head is block-driven, the MC heaters are driven in synchronism with ejection from each block, and when the number of print dots largely changes, as described above, low-frequency vibration control is continuously performed.

Figure 20:
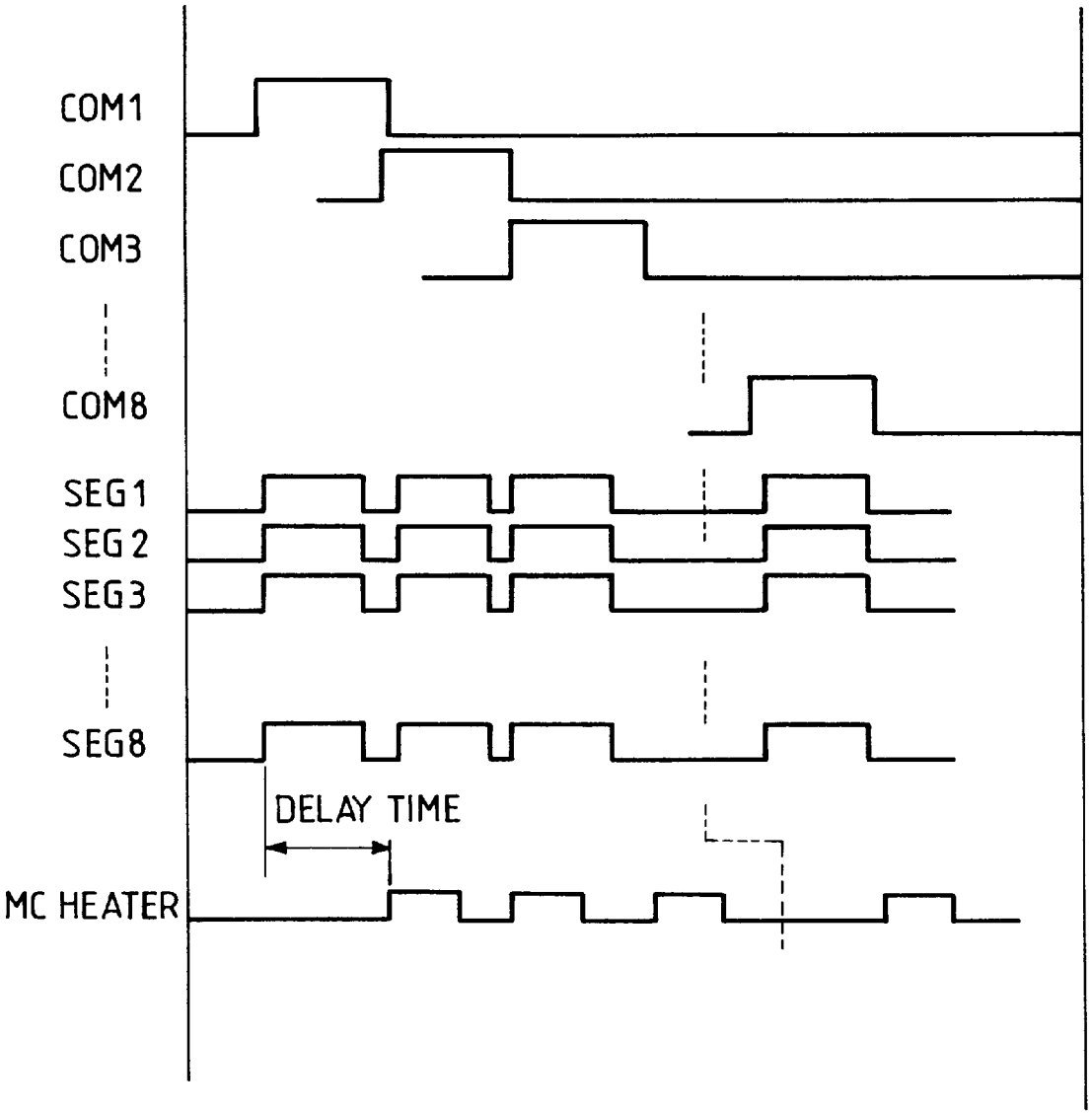
FIG. 20 is a timing chart of the fourth embodiment of the present invention.

FIG. 20 is a timing chart showing the heater driving timings synchronized with blocks when the control of this embodiment is used. When it is difficult to continuously drive the MC heaters 5500 at a short period, the control of this embodiment can be achieved by alternately driving a plurality of MC heater groups. When the MC heaters are driven in synchronism with each block of the block driving operation, whether or not synchronized control is necessary may be discriminated by checking if the change width of the number of print dots is large or small. After foaming by ejection from each block, the MC heaters 5500 are driven after an elapse of a certain delay time, as shown in FIG. 20, thereby applying a pressure wave before the meniscus of the ejected nozzle reaches a maximum recession amount after ejection. Thus, the control is made to prevent an increase in maximum meniscus recession amount. In the principle of ejection, meniscus recession means a state wherein the meniscus recedes by an inertia caused by the reactive pressure of ejection. Therefore, the meniscus recession amount is controlled by canceling the inertia by generating a pressure wave produced by the MC heaters before the maximum meniscus recession amount is reached.

Figure 21A:
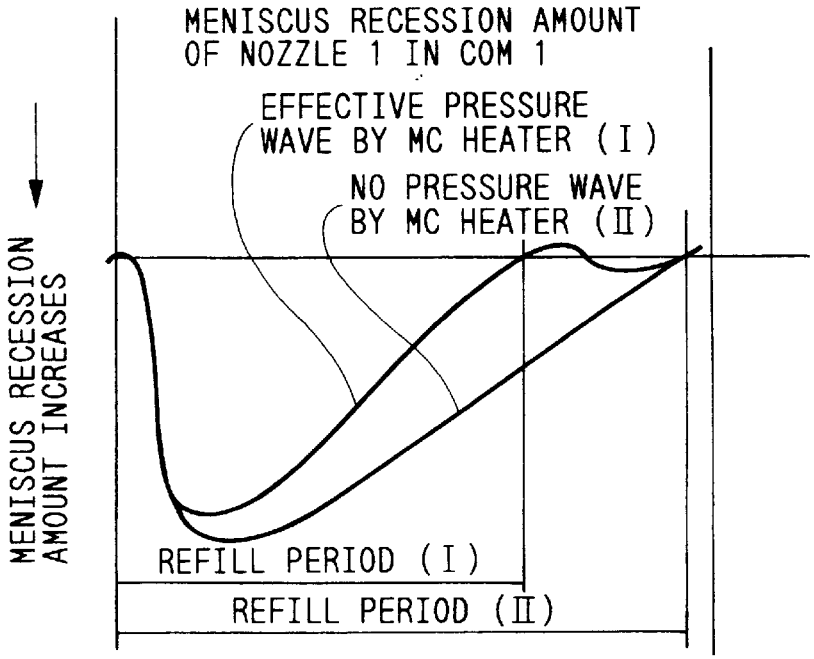
FIGS. 21A to 21C are explanatory views showing the refill improvement effect according to the fourth embodiment of the present invention.
Figure 21B:
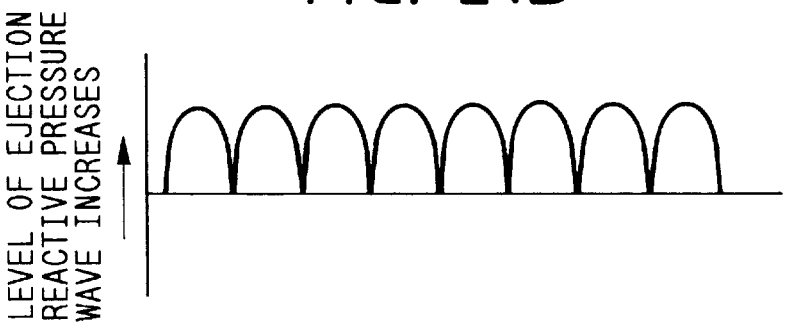
Figure 21C:
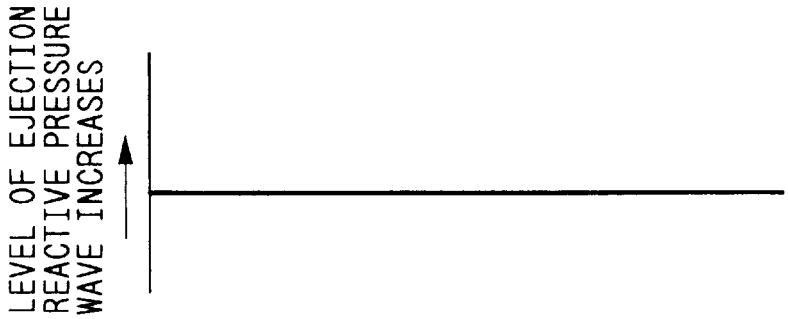

Thereafter, when the MC heaters are driven for other blocks, a pressure wave is applied to previously driven nozzles several times. Thus, as shown in FIGS. 21A to 21C, an effect of increasing the refill speed can also be obtained. Furthermore, as for the low-frequency vibration, since vibrations having different frequencies are produced, and the probability of the presence of the bubble space increases, it is considered that the vibration absorption effect can also be improved.

(Fifth Embodiment)

A case will be described below wherein the driving control of the MC heaters 5500 is changed in correspondence with the state of the recording head. A vibration produced in the recording head is determined by physical constants such as the impedance design of the recording head, the negative pressure in the ink tank, and the viscosity, surface tension, and the like of an ink. Measurable parameters include the temperature of the recording head, the environmental temperature, the ink remaining amount, the corresponding count value of a dot counter, and the like.

A low-frequency vibration is largely influenced by the ink remaining amount, and a change in viscosity of the ink. Therefore, in the flow chart in FIG. 19, the control of this embodiment can be achieved by controlling step S153 for defining the phase inversion time of X columns. More specifically, since the assumed resonance frequency tends to decrease when the viscosity increases, or when the negative pressure in the tank increases due to a decrease in ink remaining amount, the control of this embodiment can be achieved by shifting parameters, which control resonance, to the lower-frequency side as well as other parameters by this parameter. The control of this embodiment is particularly effective when a vibration is controlled by driving the MC heaters in a phase opposite to that of the vibration in correspondence with the resonance frequency like in the third embodiment.

As described above, according to the first to fifth embodiments, since the pressure producing means for controlling a vibration is arranged in the common ink chamber, vibrations in a wide frequency range such as a natural vibration of a tank system in a low-frequency range, which cannot be controlled by the conventional method, a vibration caused by ejection, and the like, can be suppressed.

More specifically, since the pressure producing means produces a pressure wave independently of ejection, i.e., produces a pressure wave having a different phase or a different phase and amplitude from those of a vibration produced by ink ejection, vibration controllability can be further improved.

As a means for producing a pressure wave in the recording head, an electrothermal energy converting element or a piezoelectric element which allows film boiling, or other known pressure producing methods can be adopted.

When the driving timing or driving frequency of the MC heaters is randomly controlled, tuning to the resonance frequency can be prevented.

(Sixth Embodiment)

Figure 22:
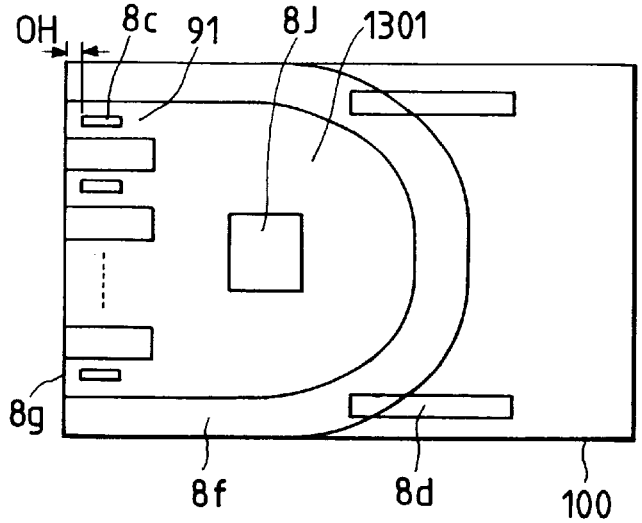
FIG. 22 is a plan view showing a recording head according to the sixth embodiment.

FIG. 22 is a view for explaining the layout of a heater board 100 of an ink jet recording head. The arrangement of the heater board 100 will be described below. Temperature control (sub) heaters 8*d* for controlling the temperature of the head, a pressure producing means (heater) 8J for producing a pressure in a common ink chamber, and ejection (main) heaters 8*c* for ejecting an ink are formed on a single substrate to have the illustrated positional relationship thereamong. Since the respective elements are arranged on a single substrate, as described above, detection and control of the head temperature can be efficiently performed, and a compact structure and a simple manufacturing process of the head can be achieved. In FIG. 22, a top plate for separating the heater board into a region filled with an ink, and another region has an outer wall section 8*f* to have the illustrated positional relationship. A space, on the side of the ejection heaters 8*c*, of the outer wall section 8*f* of the top plate serves as a common ink chamber 1301. Note that ink channels (nozzles) 91 are formed by groove portions formed on an ejection portion array of the outer wall section 8*f* of the top plate and the channels terminate as ink orifices 8*g*.

Since a recording apparatus exemplified in this embodiment is a high-speed response recording apparatus, each nozzle 91 has a high-response, short nozzle structure having a sufficiently small nozzle impedance. However, each nozzle 91 is controlled not to cause an adverse effect, i.e., a decrease in conversion efficiency of input energy to ejection energy, which is caused by a small nozzle backward impedance.

More specifically, when each ejection heater 8*c* is driven to generate a bubble in the corresponding nozzle, and foaming energy of the bubble is converted into ejection energy, the pressure producing means 8J in the common ink chamber is driven to control the pressure level behind the nozzle (on the side of the ink tank) to be temporarily set in a pressurized state, thereby efficiently converting the foaming energy of the bubble into ejection energy of an ink.

An arrangement which adopts short nozzles to realize a high-speed response, and controls to prevent a decrease in conversion efficiency of input energy caused by a small backward impedance will be described in detail below with reference to the accompanying drawings.

Figure 23A:
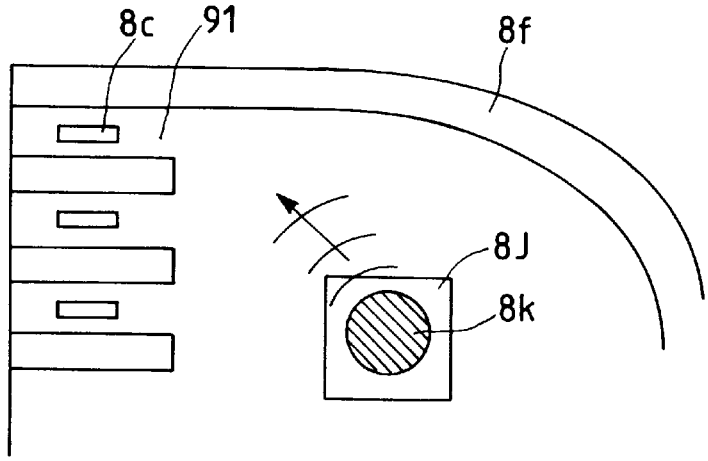
FIGS. 23A and 23B are explanatory views for explaining a transmission state of a pressure produced by pressure producing means.
Figure 23B:
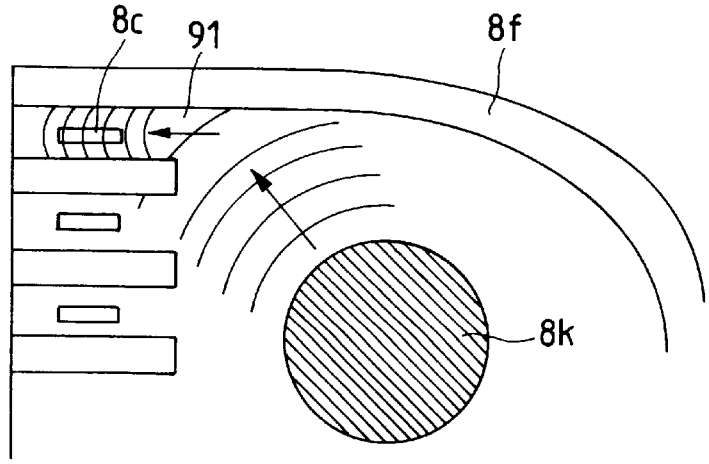

FIGS. 23A and 23B are views for explaining the pressure distribution in the common ink chamber and the nozzles. FIGS. 23A and 23B illustrate the ejection heaters 8*c* for ejecting an ink, the outer wall section 8*f* of the top plate, the nozzles 91, the pressure producing means (heater in this embodiment) 8J, and a bubble 8*k* formed by the pressure producing heater 8J. FIG. 23A shows the pressure state in the ink chamber immediately after the pressure producing heater 8J is driven to form a bubble prior to driving of the ejection heaters 8*c*. An ink portion in a liquid phase around the heater 8J transfering to a vapor phase upon reception of thermal energy, and causes volume expansion, thus producing a pressure in the common ink chamber.

FIG. 23B shows a state wherein the phase transition of the ink further progresses, and the pressure level in the common ink chamber further increases. At this time, the pressure is transmitted along concentric circles around the bubble. However, as is well known, in a small-diameter tube, since the pressure is transmitted in a direction parallel to the longitudinal direction of the tube, the pressure is applied from a position behind the nozzles toward ejection orifices in this embodiment. After this state is established, the ejection heaters are driven to form bubbles in the nozzles. Thus, even in the recording head having a high-response, short nozzle arrangement with a small backward impedance (low flow path resistance), the apparent backward impedance increases together with the pressure wave produced by the pressure producing heater, and backward relief of foaming energy by the ejection heaters can be eliminated, thereby attaining efficient energy conversion. Note that the pressure producing means has an arrangement for forming a bubble in the common ink chamber by supplying electric energy to an electrothermal energy converting element. More specifically, in this embodiment, the pressure producing means is driven by applying a voltage of 25 V to a heat generating resistor $HfB_2$ having a resistance of 150 Ω for 10 μs. Furthermore, the pressure producing means is driven 10 μs before the driving timing of the ejection heaters, so that the pressure wave produced by the pressure producing means is efficiently transmitted.

Figure 24:
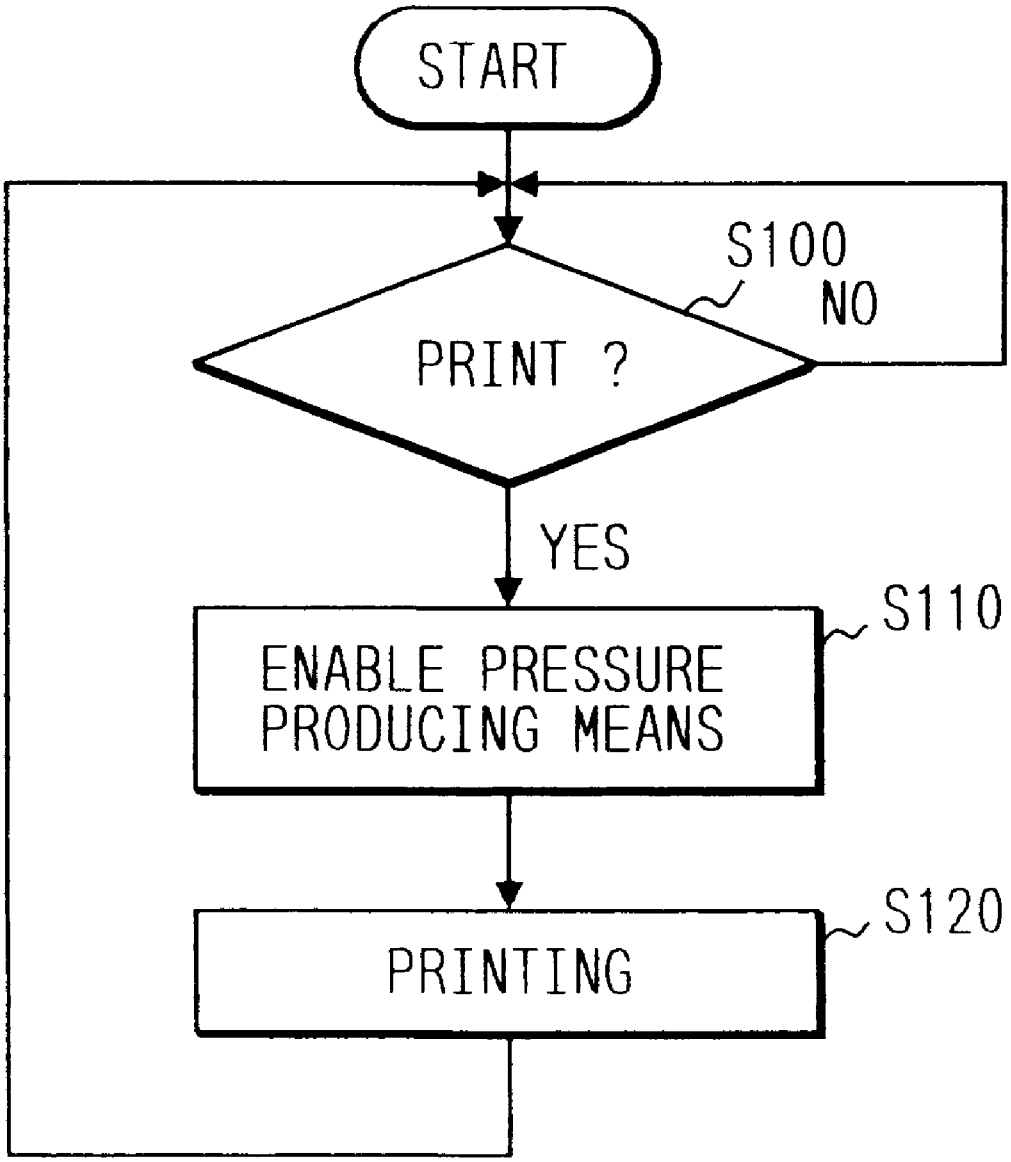
FIG. 24 is a flow chart showing an operation.

The operation upon execution of recording using the recording apparatus with the above-mentioned arrangement will be described below with reference to the flow chart in FIG. 24.

When a print command is input in step S100, the pressure producing means (heater 8J) is driven 10 μs before the driving timing of the ejection heaters (S110). A bubble is formed in the common ink chamber upon driving of the pressure producing heater 8J, and the ejection heaters 8*c* for performing a print operation are driven at a timing at which an ink portion behind nozzles is pressurized by a pressure wave produced by forming the bubble (step S120 ). Upon completion of a print operation for one column, the flow returns to step S100 to wait for a print operation for the next column. If a print command for the next column has already been input, the same control as described above is repeated.

In some recording apparatuses, in place of driving all the nozzles at the same time, the nozzles are divided into some blocks, and are driven in units of blocks. In such an apparatus, control may be made to drive the pressure producing means at all timings before the driving timings of the blocks.

With the above-mentioned control, the nozzle backward impedance at the ejection foaming timing on the ejection heater can be apparently and temporarily increased not by any structural means but by control means.

In this embodiment, the driving timing of the pressure producing means (heater) is set to be a timing 10 μs before the driving timing of the ejection heaters. As described above, since the pressure producing heater is driven to apparently increase the nozzle backward impedance upon driving of the ejection heaters, the present invention is not limited to a timing 10 μs before as long as the nozzle backward impedance can be increased. As the driving timing of the pressure producing heater, it is preferable to drive the pressure producing means within a range wherein the pressure produced by the pressure producing means still remains at the beginning of foaming upon driving of the ejection heaters, and at a timing before a bubble formed upon driving of the ejection heaters reaches a maximum foaming point (the bubble has completely grown).

As described above, this embodiment is characterized by comprising pressure producing means arranged in the common ink chamber, and pressure producing timing control means for controlling the driving timing of the pressure producing means. Thus, the nozzle backward impedance can be apparently increased without using a long nozzle structure which has a high flow path resistance and disturbs a high-speed response, and a flow resistance structure in nozzles, which cannot always easily achieve high ejection reliability, thus allowing high-speed, high-image quality recording.

(Seventh Embodiment)

The seventh embodiment, which can prevent a change over time in pressurizing force for pressurizing an ink portion behind the nozzles by a pressure produced by the pressure producing means in the common ink chamber, and can maintain a constant pressurizing force all the time, will be described below.

An ink to be supplied into the common ink chamber is stored in the ink tank behind (at the downstream side of) the common ink chamber. In the ink tank, the ink is held by a foamed porous member (absorbing member), as described above. At this time, the ink holding force is generated by a capillary force (surface tension) of each pore of the porous member, and changes depending on the surface area, contacting air, of the ink in the tank. More specifically, as the ink remaining amount in the ink tank decreases, the force for holding the ink by the porous member increases, and the negative pressure level in the common ink chamber increases. The negative pressure level in the common ink chamber normally increases in inverse-proportion to the ink remaining amount.

Therefore, when the ink remaining amount decreases, and the negative pressure toward the ink tank side in the common ink chamber increases, the ratio of the pressure wave which is relieved toward the ink tank side increases even when the pressure producing means is driven. For this reason, a desired pressurizing force for an ink behind the nozzles cannot often be obtained. As a countermeasure against this problem, the pressure producing level of the pressure producing means 8J is controlled in correspondence with the ink remaining amount.

In this embodiment, the bubble length in the common ink chamber is controlled by controlling the driving operation of the pressure producing means 8J in correspondence with a decrease in ink remaining amount. More specifically, when the negative pressure level behind the common ink chamber increases due to a decrease in ink remaining amount in the ink tank, and the required pressure level to be produced before ejection is to be increased, the bubble length is increased by decreasing the driving voltage to be applied to the pressure producing means so as to obtain a desired pressurizing level. The principle of increasing the bubble length by decreasing the applied voltage will be described below.

When energy is input to an electrothermal energy converting element as the pressure producing means in this embodiment, an ink portion near the boundary surface of the electrothermal energy converting element is heated. When heating is further continued, foaming is started. At this time, the bubble length depends on the number of evaporated molecules of the ink, and the number of evaporated molecules is determined by the amount of heat conducted from the electrothermal energy converting element to the ink until the ink near the boundary surface is evaporated. More specifically, when the driving voltage of the electrothermal energy converting element is high, the ink near the boundary surface is evaporated before heat is conducted deep to the ink, and the electrothermal energy converting element is covered with a gas. Since the heat conduction rate of a gas is very low, the electrothermal energy converting element is set in a thermally insulated state after evaporation. For this reason, almost no new thermal energy is conducted to the ink, and a state change of only a small number of ink molecules near the electrothermal energy converting element, which molecules receive heat before evaporation occurs. As a result, the bubble length becomes small. On the other hand, when the driving voltage of the electrothermal energy converting element is low, since the ascending gradient of the surface temperature of the electrothermal energy converting element is moderate, and heat can be conducted deep to the ink as compared to the case of the high driving voltage, the number of evaporated molecules increases, and the bubble length becomes large.

Therefore, as described above, when the driving voltage of the pressure producing means is controlled in correspondence with the required pressure level according to the ink remaining amount, a stable backward impedance can be generated upon ejection independently of a variation factor which changes over time (ink remaining amount). In this embodiment, since the countermeasure of this embodiment is attained by control means, the variation factor which changes over time can be flexibly coped with.

Furthermore, a large-capacity ink tank is demanded at present to meet recent requirements for a decrease in running cost and for a decrease in exchange frequency of the ink tank in view of ecology. Since a large-capacity ink tank has a large change width of the negative pressure caused by the ink remaining amount, the necessity of the present invention is expected to grow increasingly larger in future.

In this embodiment, as means for controlling the required pressure, the foamed volume is controlled by the pressure producing means. Alternatively, the required pressure control means may be realized by controlling the foaming speed. When foaming occurs in the common ink chamber, the volume of the evaporated ink molecules is expanded. In this case, in order to absorb the expanded volume, the ink must move. The ink causes a time lag from the foaming start timing due to its inertia until it begins to move. Thus, when the evaporation/expansion speed of the ink is controlled, the pressure level in the common ink chamber can be temporarily controlled by utilizing the time lag until the ink begins to move. Therefore, backward impedance control can be realized by the means for controlling the foaming speed in place of the means for controlling the foamed volume. Also, since control means for controlling the driving voltage to be applied to a driving element is a general one, and is known to those who are skilled in the art, a detailed description thereof will be omitted.

The arrangement and operation other than the control means for controlling, over time, the pressure produced by the pressure producing means are the same as those in the above embodiment, and a detailed description thereof will be omitted.

(Eighth Embodiment)

An embodiment which can always maintain a constant pressurizing force for pressurizing an ink portion behind the nozzles by a pressure produced by the pressure producing means in the common ink chamber, independently of a change in foaming efficiency of the pressure producing means due to an external factor will be described below.

In an ink jet recording head, as can be understood from the above-mentioned ejection theory, the foaming force of a bubble on the electrothermal energy converting element depends on the ink temperature near the electrothermal energy converting element. More specifically, even when energy to be applied to the electrothermal energy converting element remains the same, the number of ink molecules which cause a state change varies depending on a difference in ink temperature as a base before application of the energy, and as a result, the foaming force (foaming efficiency) varies.

A small increase in foaming force can increase the nozzle backward impedance, and can enhance the effect of the present invention. However, a large increase in foaming force makes the state of a meniscus at the nozzle leading end unstable, and deteriorates print quality upon recording. A decrease in foaming force decreases the nozzle backward impedance, and the effect of the present invention cannot be sufficiently provided.

Therefore, even when the foaming force of the pressure producing means is either too large or small, the effect of the present invention cannot be sufficiently provided, and adverse effects occur in some cases.

In this embodiment, in order to solve this problem, the temperature of the heater board is detected as an index of the ink temperature near the pressure producing means, and energy to be applied to the pressure producing means is controlled in accordance with the detected value.

Table 1 below summarizes the relationship between the heater board temperature and optimal application energy (optimal pulse width in this case) to the pressure producing means in this embodiment.

TABLE 1

| Heater Board Temperature | 10° C. or less | up to 15° C. | up to 20° C. | up to 25° C. | 30° C. or more |
|---|---|---|---|---|---|
| Optimal Pulse Width | 8.5 μs | 8.0 μs | 7.5 μs | 7.0 μs | 6.5 μs |

Note that the applied voltage is 25.6 V, and the resistance of the pressure producing means (heater) is 150 Ω.

Note that as detection means of the temperature of the heater board, a method wherein the temperature is obtained by arithmetic processing from energy applied to the heat generating portion on the heater board, a method wherein an element (sensor) such as a diode or aluminum whose resistance changes in correspondence with temperature is formed on the same substrate as the heater board, and the resistance is detected, and the like are available. However, these methods are known to those who are skilled in the art, and a detailed description thereof will be omitted.

In this embodiment, the control means for controlling energy to be applied to the pressure producing means is realized by controlling the applied pulse width. However, another method, e.g., a voltage control method may be adopted.

The detected temperature of the heater board is used as an index of the ink temperature near the heater. However, when sufficient performance can be obtained by rough control depending on the mounting position of a product or the variation characteristics inherent to the recording head, the environmental temperature, duty ratio, and the like may be used as the index.

The arrangement and operation other than the means for making uniform the foaming efficiency of the pressure producing means are the same as those in the above embodiment, and a detailed description thereof will be omitted.

According to the sixth to eighth embodiments of the present invention, since the pressure producing means arranged in the common ink chamber is driven immediately before ejection of the ejection heaters, the backward impedance can be increased without arranging a long nozzle structure which disturbs a high-speed response, and flow resistant structure in nozzles, and an ink jet recording apparatus which allows high-speed, high-image quality recording can be provided.

(Ninth Embodiment)

The sixth to eighth embodiments are all in all effective means since they are free from problems associated with a high-speed response and structure. However, in some recording heads, the duration of the pressure is still insufficient, and it is required to increase the backward impedance for a desired period of time. Also, the number of nozzles tends to be large to meet a recent requirement for high-speed operations of recording apparatuses. In a recording head having a plurality of nozzles, since the distances from the pressure producing means in the common ink chamber to pressure acting portions vary in units of nozzles, a pressure loss may occur in a nozzle having a long distance as described above, and a desired backward impedance cannot often be obtained.

The ninth embodiment satisfies the above-mentioned requirement.

Figure 25:
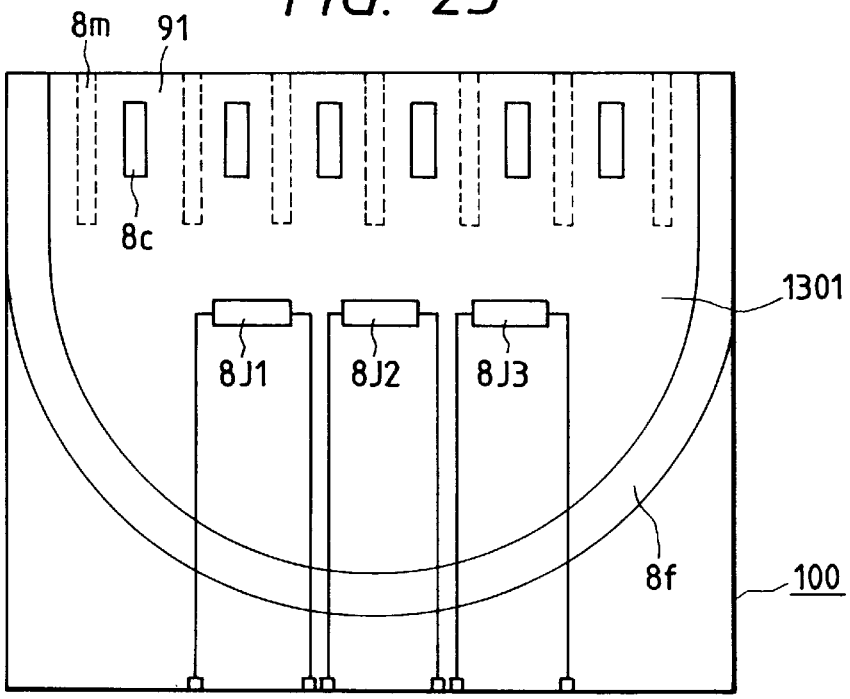
FIG. 25 is a plan view showing a recording head chip according to the ninth embodiment.

FIG. 25 is a view for explaining the layout of a heater board 100 of an ink jet recording head of this embodiment. The arrangement of the heater board 100 will be described below. A plurality of pressure producing means 8J1 to 8J3 for producing a pressure in the common ink chamber, and ejection (main) heaters 8c for ejecting an ink are formed on a single substrate to have the illustrated positional relationship therebetween. Since the respective elements are arranged on a single substrate, as described above, control of the head can be efficiently performed, and a compact structure and a simple manufacturing process of the head can be achieved. In FIG. 25, a top plate for separating the heater board into a region filled with an ink, and another region has an outer wall section **8*f* to have the illustrated positional relationship. A space, on the side of the ejection heaters 8*c*, of the outer wall section 8*f* of the top plate serves as a common ink chamber 1301. Note that ink channels (nozzles) 91 are defined by groove portions formed by partition plates 8*m* for forming an ejection portion array of the outer wall section 8*f*** of the top plate.

Since a recording apparatus exemplified in this embodiment is a high-speed response recording apparatus, each nozzle 91 has a high-response, short nozzle structure having a sufficiently small nozzle impedance, and is designed to have a low-impedance structure to cope with an increase in flow rate per unit time. Therefore, there are fears of the above-mentioned adverse effect of impairing conversion efficiency of input energy to ejection energy due to a small backward impedance, and problems of a vibration and resonance caused by a vibration of an ink, which is produced when an ink in a nozzle begins to move (immediately after the beginning of ejection) or is stopped (immediately after the stop of ejection) by an inertia of the ink itself, and which is not sufficiently attenuated. However, in this embodiment, in order to solve these problems, the pressure producing means which can produce a sufficiently high pressure for a sufficiently long duration are arranged in the common ink chamber 1301, and are properly controlled as needed. Therefore, the above-mentioned problem are not posed.

The details of the pressure producing means which can produce a sufficiently high pressure for a sufficiently long duration will be described below with reference to FIG. 25.

Figure 26:
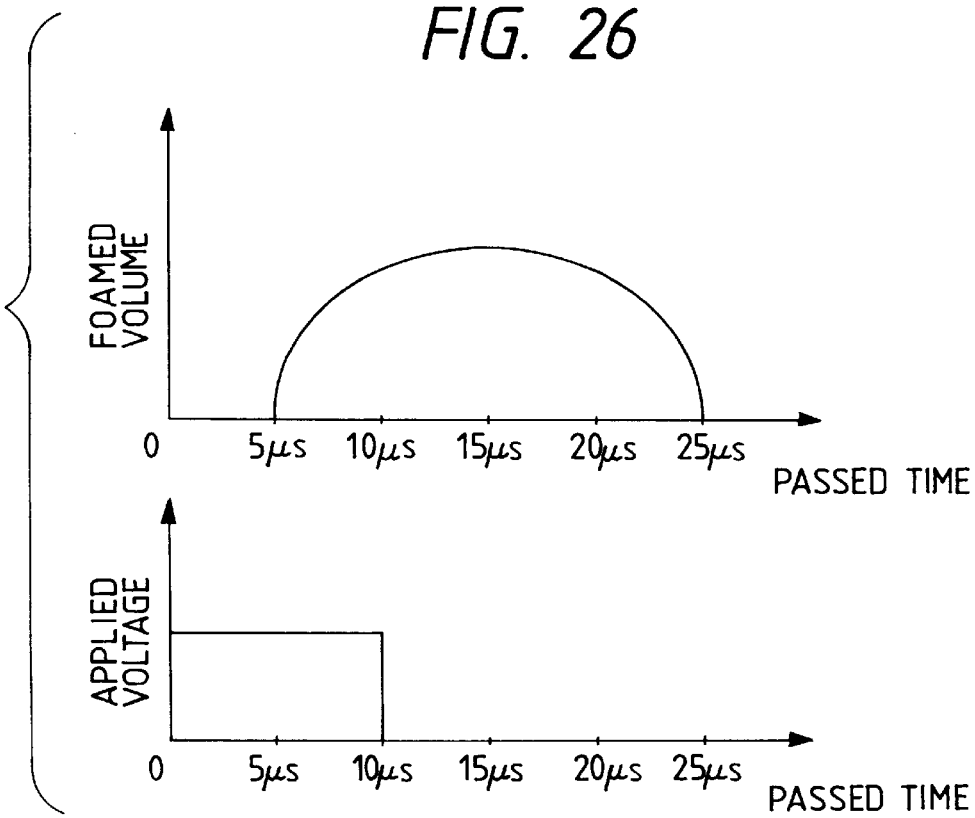
FIG. 26 is an explanatory view for explaining the energy application timing and the foaming/collapsing timing.

As shown in FIG. 25, in this embodiment, the three pressure producing means 8J1 to 8J3 are arranged in the common ink chamber 1301. Each pressure producing means is driven by applying a voltage of 25 V to a heat generating resistor $HfB_2$ having a resistance of 150 Ω for 10 μs. More specifically, when electric energy is input to the pressure producing means 8J1 to 8J3, the pressure producing means 8J1 to 8J3 generate heat, cause a state change of an ink (phase transition to a vapor phase) by heating the ink to start foaming, and produce a pressure in the common ink chamber by a change in volume caused by foaming. The pressure increases the nozzle backward impedance and controls to suppress a vibration and resonance of an ink in the channels. However, as described above, since it is preferable that a bubble formed by foaming collapse reliably, the bubble is normally formed by a state change of ink molecules. More specifically, although the above-mentioned large energy is instantaneously applied to start foaming, the bubble collapses simultaneously with stopping of the energy application. The foaming and collapsing timings obtained upon application of energy to the pressure producing means 8J1 to 8J3 under the above-mentioned condition are as shown in FIG. 26.

After an elapse of about 6 μs from the application of the energy, foaming is started on the pressure producing means 8J1 to 8J3, and the length of each bubble gradually increases. Although an increase in bubble length continues even after the energy application, it is assumed that this increase is caused by the inertia of an ink around each bubble. Thereafter, when the shrinkage force due to an increase in internal negative pressure of a bubble gas exceeds the increasing force due to the inertia of the ink around the bubble, the bubble shrinks in turn, and finally collapses. In this test, as shown in FIG. 26, the foaming time was about 10 μs, the collapsing time was about 10 μs, and a total existing time of the bubble as a gas was 20 μs.

Even with the above-mentioned foaming duration, improvement of input energy conversion efficiency by an increase in nozzle backward impedance, and the suppression effect of a vibration and resonance of an ink in the nozzles can be realized. However, in a recording head which has a high-response, short nozzle structure with a sufficiently small nozzle impedance, and a low-impedance nozzle structure corresponding to an increase in flow rate per unit time like in this embodiment so as to cope with requirements for high-speed operations of recent recording apparatuses, it is necessary and indispensable to further prolong the pressure duration. As a countermeasure against this problem, in this embodiment, the plurality of pressure producing means 8J1 to 8J3 are arranged in the common ink chamber 1301, as shown in FIG. 25, thereby prolonging the pressure duration.

Figure 27:
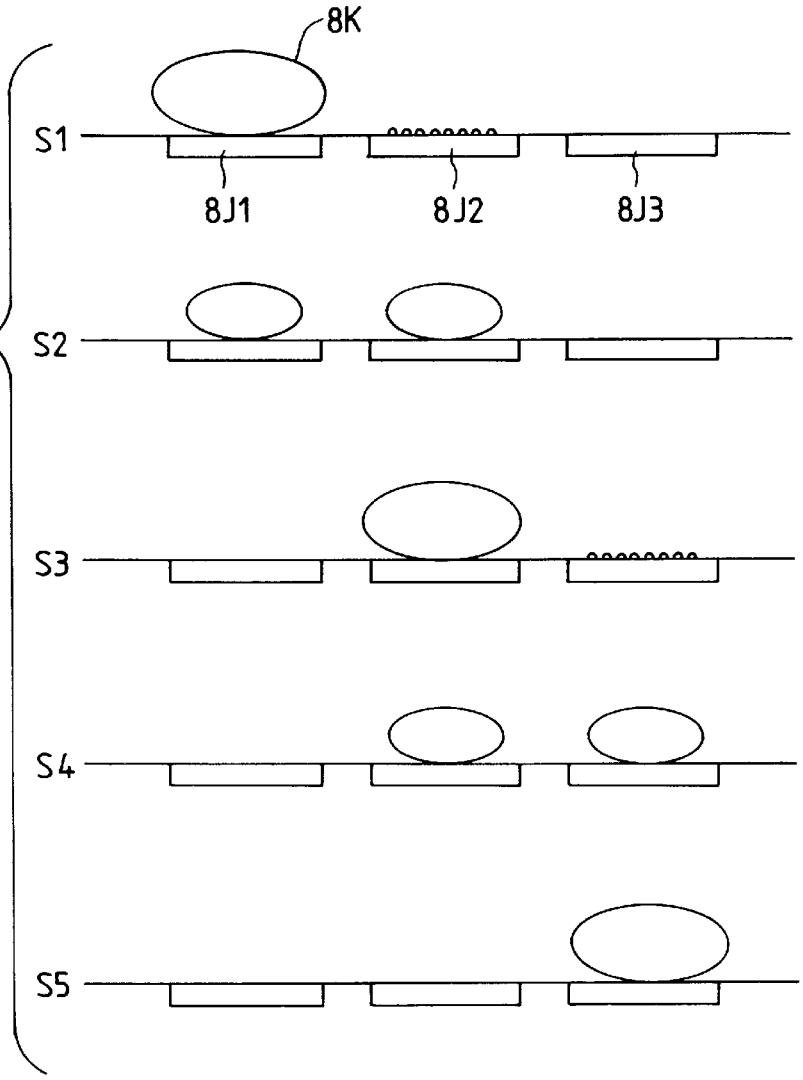
FIG. 27 is an explanatory view of a maintained pressure obtained when a plurality of pressure producing means are driven.

A method of prolonging the pressure duration will be described below with reference to FIG. 27. FIG. 27 shows a state S1 wherein the pressure producing means 8J1 is driven under the above-mentioned driving condition to cause a foaming phenomenon on the means 8J1. Conventionally, since the duration of the produced pressure ends upon collapse of the bubble, the produced pressure is cleared in about 20 μs under the above-mentioned driving condition, as has been described above with reference to FIG. 26. However, in this embodiment, simultaneously with collapse of the bubble formed on the pressure producing means 8J1, the neighboring pressure producing means 8J2 starts foaming, as shown in a state S2 in FIG. 27, and almost no decrease in produced pressure occurs. Similarly, since the neighboring pressure producing means start foaming in turn, as shown in states S3, S4, and S5, the produced pressure can be maintained over a long period of time.

Figure 28:
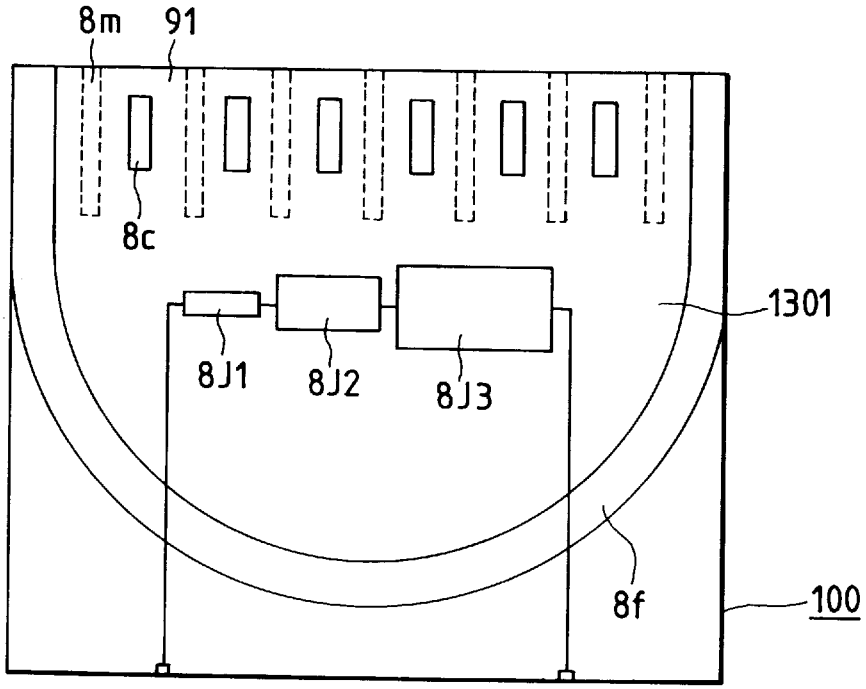
FIG. 28 is an explanatory view showing control for simultaneously controlling the plurality of pressure producing means.

FIG. 28 shows a modification of this embodiment. In the above embodiment, the plurality of pressure producing means in the common ink chamber 1301 are independently ON/OFF-controlled. However, as shown in FIG. 28, the plurality of pressure producing means 8J1 to 8J3 may be connected in series. More specifically, the pressure producing means 8J1 to 8J3 as heat generating members connected in series are set to have different watt densities (heat generating amount per unit area), thereby delaying a time required until an ink foams on each pressure producing means upon supply of a current. As described above, in this embodiment, since a thin film heat generating member is used as the pressure producing means, the sheet resistances of the means 8J1, 8J2, and 8J3 are equal to each other. For this reason, by adjusting the areas, and the aspect ratios of the pressure producing means, the watt densities (times until beginning of foaming) can be controlled. More specifically, even when the length is doubled to make an area four times without changing the aspect ratio, since the resistance is constant, the total heat generating amount obtained by connecting the four means in series equals that before the modification. Since contact areas with an ink have a ×4 difference, the watt densities also have a ×4 difference, and the foaming start times of an ink on the pressure producing means have a difference.

By utilizing the above-mentioned principle, when a plurality of pressure producing means having different watt densities are connected in series, bubble formation can be controlled with a desired time difference, and the pressure duration can be prolonged without independently ON/OFF-controlling the pressure producing means.

Figure 29:
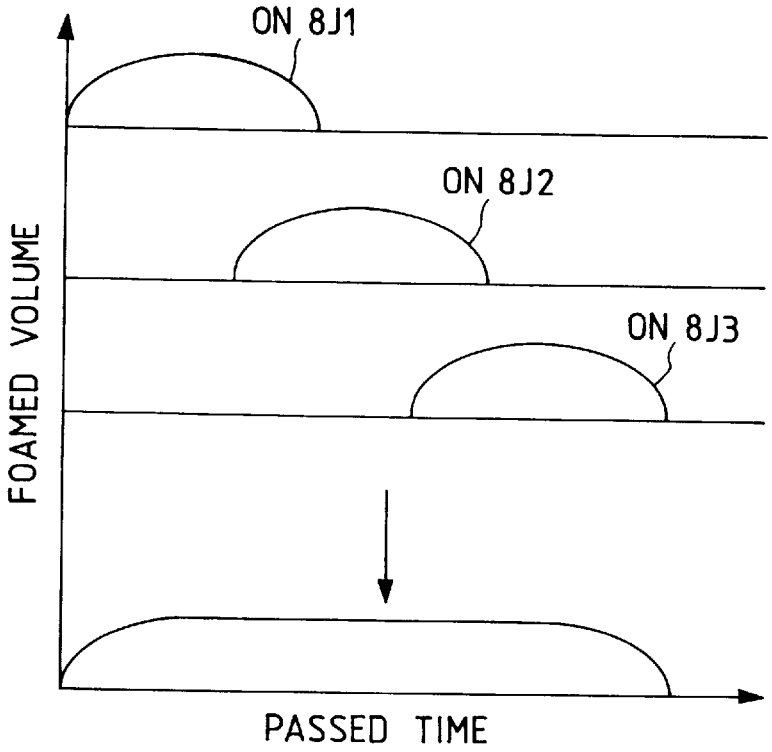
FIG. 29 is an explanatory view of a pressure maintaining state over time when the plurality of pressure producing means are used.

FIG. 29 shows a pressure maintaining state obtained when a pressure is produced by the above means. As can be seen from FIG. 29, the pressure duration can be doubled by arranging the three pressure producing means. As for the duration of the maximum pressure level, the maximum pressure level is maintained as a point in a conventional method, while it can be maintained as a range in the present invention.

Figure 33:
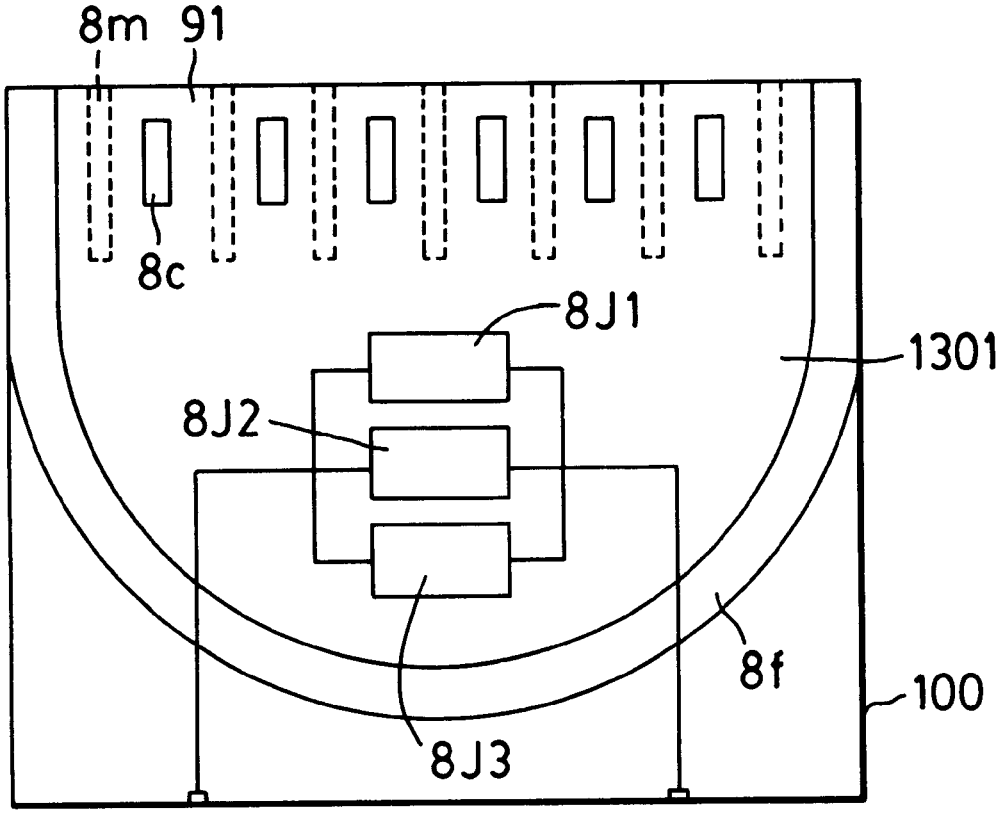
FIG. 33 is a plan view showing a recording head chip according to a further embodiment.

Since the pressure producing means having different watt densities are connected in series, the effect of the above embodiment can be obtained without executing any special control. In this embodiment, the pressure producing means are connected in series, as described above. However, the pressure producing means may be connected in parallel (as shown in FIG. 33, for example) as long as the foaming timing is changed by different watt densities.

Furthermore, in this embodiment, the pressure producing means have the same film thickness (sheet resistance) in consideration of simplicity in film formation means. However, the present invention may adopt either means for controlling the foaming timing by the film thickness or means for controlling the foaming timing by totally considering the film thickness, area, and aspect ratio.

As described above, according to this embodiment, a decrease in input energy conversion efficiency due to the high-response, short nozzle structure which has a sufficiently small nozzle impedance to meet requirements for high-speed operations of recent recording apparatuses, problems of a vibration and resonance caused by a low-impedance nozzle structure which can cope with an increase in flow rate per unit time, and the like can be solved. More specifically, by using at least one of driving timing control means for controlling the driving timings of a plurality of pressure producing means, and a plurality of pressure producing means having different watt densities, the pressure duration can be prolonged, the effect of preventing the above-mentioned problems can be remarkably improved, and high-speed, high-image quality recording can be performed.

[10th Embodiment]

Another embodiment for more effectively applying a pressure produced by the pressure producing means will be described below.

In the above embodiment, the backward impedance is increased, and the vibration/resonance suppression effect is improved by prolonging the pressure duration by driving a plurality of pressure producing means at different timings. In this embodiment, by selectively driving pressure producing means arranged at optimal positions, control is made to obtain a practical effect even by driving a small number of pressure producing means.

When energy is applied to the pressure producing means, a pressure is produced in the common ink chamber. Since the produced pressure is attenuated in correspondence with the distance to a pressure acting portion, the efficiency of the effect on the acting portion varies. The present inventors analyzed the principle of this pressure attenuation as follows.

In an ink jet recording head, an ink chamber space is not a closed space, and has opening portions such as nozzle orifices. Therefore, when a pressure is produced by the pressure producing means in the common ink chamber, the shape of a meniscus at each opening portion such as a nozzle orifice changes to absorb the pressure, thus causing a change in volume. More specifically, a pressure releasing phenomenon accompanying ink movement occurs. A pressure loss (consumption) upon movement occurs in correspondence with the moving distance of the ink, and a lower pressure acts on a pressure acting portion far from the pressure producing means than that acting on a pressure acting portion near the pressure producing means, thus lowering the efficiency of the pressure producing means.

In this embodiment, in consideration of the above-mentioned phenomenon, the driving position of an ejection heater as ejection means is detected, and the pressure driving means at an optimal position is selectively driven in accordance with the detected driving position, i.e., the pressure producing means closest to the ejection heater to be driven is selected, and is driven.

Figure 30:
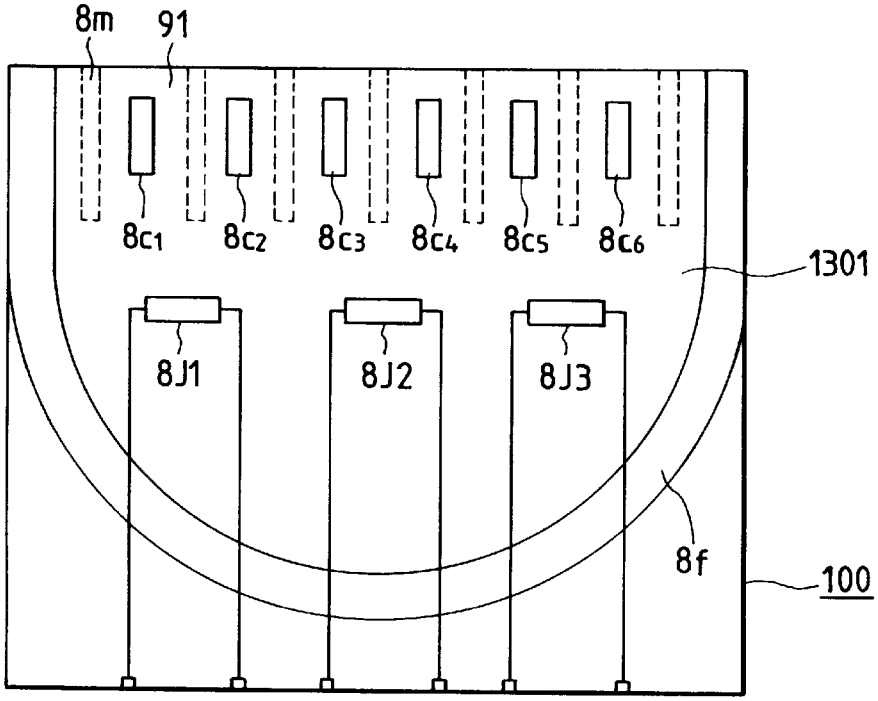
FIG. 30 is a view for explaining the present invention.

FIG. 30 shows a heater board of a recording head, which can realize the above-mentioned control. In this embodiment, six ejection heaters 8*c* (8*c*1 to 8*c*6 ) as ejection driving means are arranged, and three pressure producing means 8J (8J1 to 8J3 ) are arranged in the common ink chamber. As shown in the plan view in FIG. 30, the pressure producing means 8J1 is arranged at a position where the means 8J1 is sufficiently close to the ejection heaters 8*c*1 and 8*c*2, and can realize the effect of a pressure producing source. Similarly, the pressure producing means 8J2 is arranged near the ejection heaters 8*c*3 and 8*c*4, and the pressure producing means 8J3 is arranged near the ejection heaters 8*c*5 and 8*c*6.

In the control of this embodiment, as described above, when at least one of the ejection heaters 8*c*1 and 8*c*2 is driven, the pressure producing means 8J1 is selectively driven; when at least one of the ejection heaters 8*c*3 and 8*c*4 is driven, the pressure producing means 8J2 is selectively driven; and when at least one of the ejection heaters 8*c*5 and 8*c*6 is driven, the pressure producing means 8J3 is selectively driven.

With this control, a pressure wave can be effectively applied with a smaller use frequency of the pressure producing means.

Thus, energy consumption can be saved. In particular, even in a battery-driven recording apparatus in which input energy is considerably limited, high-speed, high-image quality recording can be realized.

The arrangement and operation other than the selective driving control means for the pressure producing means are the same as those in the above embodiment, and a detailed description thereof will be omitted.

[11th Embodiment]

An embodiment for automatically selecting an optimal driving position of a plurality of pressure producing means in an ink jet recording apparatus having the plurality of pressure producing means in a common ink chamber will be described below. In the above embodiment, the driving position of an ejection heater is detected, and a pressure producing means located at an optimal position is selected and driven in accordance with the detected value. However, this embodiment requires neither the detection means for detecting the driven ejection heater nor control for selecting an optimal pressure producing means. This embodiment will be described in detail below with reference to the accompanying drawings.

Figure 31:
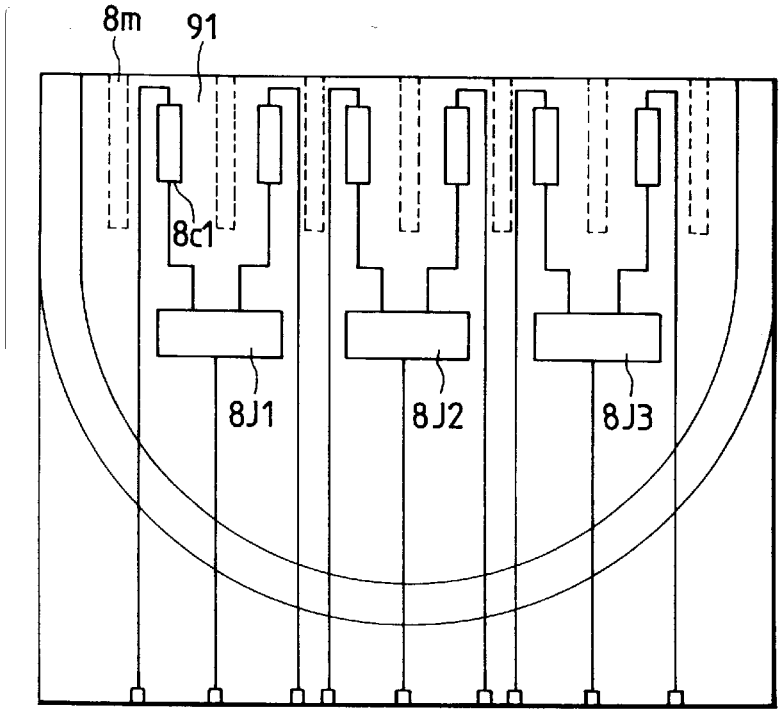
FIG. 31 is a view for explaining the present invention.

FIG. 31 is an explanatory view for explaining driving position automatic selection means of a plurality of pressure producing means in the common ink chamber according to this embodiment. FIG. 31 illustrates nozzles 91, partition plates 8*m* for defining the nozzles, ejection heaters 8*c*, and pressure producing heaters 8J. As can be seen from FIG. 31, the ejection heaters 8*c* and the pressure producing means 8J are connected in series. Therefore, the ejection heaters 8*c* and the pressure producing means 8J are energized at the same time. However, as has been described in the ninth embodiment, when the pressure producing means have different watt densities in accordance with desired different foaming timings, the different foaming timings can be realized.

With this arrangement, pressure production control can be efficiently performed by a simple arrangement and control. Even in an inexpensive apparatus, both high-speed processing and high image quality can be realized.

In this embodiment, the ejection heaters 8*c* and the pressure producing means 8J are connected in series, but may be connected in parallel, as has been described in the ninth embodiment.

The arrangement and operation other than the pressure production simultaneous control means obtained by connecting the pressure producing means in series are the same as those in the above embodiment, and a detailed description thereof will be omitted.

[12th Embodiment]

Another embodiment for arranging pressure producing means in nozzles will be described below.

In each of the above embodiments, the pressure producing means are arranged in the common ink chamber, but may be arranged in nozzles.

Figure 32:
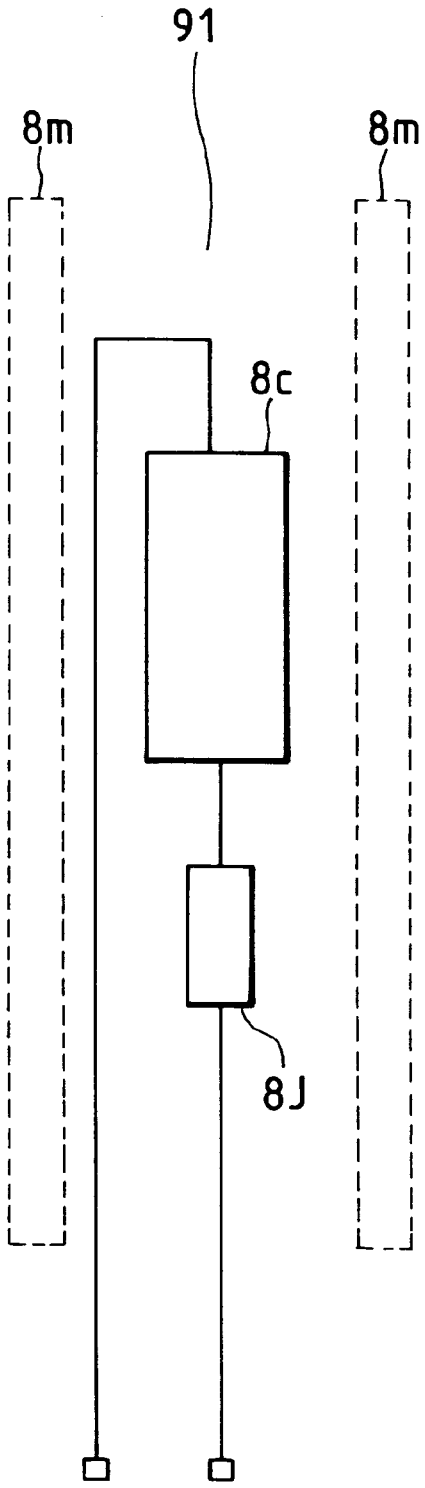
FIG. 32 is a view for explaining the present invention.

FIG. 32 is a plan view showing pressure producing means arranged in each nozzle. As can be seen from FIG. 32, the ejection heater 8*c* and the pressure producing means 8J are connected in series in the nozzle. As in the ninth or 11th embodiment, the pressure producing means have different watt densities as needed so as to realize a difference between the foaming timings of the ejection heaters 8*c* and the pressure producing means 8J.

When recording is performed using a recording head with the above-mentioned arrangement, foaming by the pressure producing means can be reliably caused to have a desired delay time from the driving operation (foaming) of the ejection heaters.

Since the pressure producing means are arranged in the nozzles, a pressure wave can be most efficiently transmitted as compared to those arranged in the common ink chamber. More specifically, since the distance between the pressure producing means and the pressure acting portion is shortened, the above-mentioned transmission loss (consumption) of the produced pressure can be eliminated, and the produced pressure can be efficiently utilized.

With the above-mentioned arrangement, pressure production control can be efficiently performed by a simple arrangement and control. Even in an inexpensive apparatus, both high-speed processing and high image quality can be realized.

The arrangement and operation other than the closest pressure production arranging means for arranging the pressure producing means in the nozzles are the same as those in the above embodiment, and a detailed description thereof will be omitted.

In each of the ninth to 12th embodiments, a plurality of pressure producing means are arranged in the common ink chamber, and are selectively driven in a desired order, thereby prolonging the pressure duration, and increasing the produced pressure. Also, the backward impedance can be increased, an ink vibration can be prevented, and high-speed processing and high-image quality can be realized.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in. Japanese Laid-Open Patent Application No. 123670/1984 wherein a common slit is used as the ejection outlet for plural electrothermal transducers, and to the structure disclosed in Japanese Laid-Open Patent Application No. 59-138461 wherein an opening for absorbing pressure waves of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head or plural recording heads combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressurizing or suctioning means, and preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single head corresponding to a single color ink, or may be plural heads corresponding to the plurality of ink materials having different recording colors or densities. The present invention is effectively applicable to an apparatus having at least one of a monochromatic mode manly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is applied. The present invention is applicable to other types of ink. In one of them, the temperature rise due to the thermal energy is positively prevented by consuming it for the state change of the ink from the solid state to the liquid state. Another ink material is solidified when it is left unused, to prevent the evaporation of the ink. In either of the cases upon, the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 54-56847 and Japanese Laid-Open Patent Application No. 60-71260. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. An ink jet recording apparatus for performing recording on a recording medium by ejecting an ink, comprising:

a plurality of ejection orifices for ejecting the ink;

a plurality of ink passages, communicating with said ejection orifices, for supplying the ink stored therein to said ejection orifices;

ejection energy producing means, arranged in said ink passages, for applying energy for ink ejection to the ink, said ejection energy producing means causing a first pressure wave;

a common chamber for supplying the ink to said ink passages;

pressure producing means, arranged in said common chamber, for producing a second pressure wave in said common chamber; and control means for controlling said election energy producing means to eject a number of record dots and for controlling said pressure producing means to produce the second pressure wave, wherein the second pressure wave reduces propagation of the first pressure wave caused by said ejection energy producing means, wherein said control means determines the number of record dots to be recorded in a predetermined record range or a change in the number of record dots and controls said pressure producing means to produce the second pressure wave according to the number of record dots to be recorded in the predetermined record range or the change in the number of record dots.

2. An apparatus according to claim 1, wherein said control means varies a timing of the second pressure wave to be produced by said pressure producing means depending on whether the change in the number of record dots increases or decreases.

3. An apparatus according to claim 1, wherein the predetermined record range is one column.

4. An ink jet recording apparatus for performing recording on a recording medium by ejecting an ink, comprising:

an ejection orifice for ejecting the ink;

an ink passage, communicating with said ejection orifice, for supplying the ink stored therein to said ejection orifice;

ejection energy producing means, arranged in said ink passage, for applying energy for ink ejection to the ink, said ejection energy producing means causing a first pressure wave, the ink in said ink passage forming a meniscus movable by a recession amount upon ejection of the ink by said ejection energy producing means;

a common chamber for supplying the ink to said ink passage;

pressure producing means, arranged in said common chamber, for producing a second pressure wave in said common chamber; and control means for controlling said pressure producing means to produce the second pressure wave, wherein the second pressure wave reduces propagation of the first pressure wave caused by said ejection energy producing means, wherein said control means controls said pressure producing means to produce the second pressure wave before the recession amount of the meniscus formed upon ejection of the ink by said ejection energy producing means becomes maximum.

5. An ink jet recording apparatus for performing recording on a recording medium by ejecting an ink, comprising:

an ejection orifice for ejecting the ink;

an ink passage, communicating with said ejection orifice, for supplying the ink stored therein to said ejection orifice;

ejection energy producing means, arranged in said ink passage, for applying energy for ink ejection to the ink, said ejection energy producing means causing a first pressure wave;

a common chamber for supplying the ink to said ink passage;

pressure producing means, arranged in said common chamber, for producing a second pressure wave in said common chamber;

receiving means for receiving information regarding at least one of a temperature and an ink remaining amount; and control means for controlling said pressure producing means to produce the second pressure wave, wherein the second pressure wave reduces propagation of the first pressure wave caused by said ejection energy producing means, wherein said control means controls said pressure producing means to produce the second pressure wave at a period according to the information regarding at least one of the temperature and the ink remaining amount.

6. An ink jet recording apparatus for performing recording on a recording medium by ejecting an ink, comprising:

ejection orifices for ejecting the ink;

a supply portion, communicating with said ejection orifices, for supplying the ink stored therein to said ejection orifices, said supply portion comprising nozzles respectively communicating with said election orifices and a common ink chamber commonly communicating with said nozzles;

ejection energy producing means, arranged in said supply portion, for applying energy at a first timing for ink ejection to the ink and producing ejection pressure and causing propagation of a pressure wave;

pressure producing means, arranged in said common ink chamber of said supply portion at an upstream side, in an ink supply direction, of said ejection energy producing means, for producing a pressurized state in said supply portion; and control means for controlling said pressure producing means to produce the pressurized state at a second timing before the first timing at which said ejection energy producing means produces the ejection pressure, so as to reduce the propagation of the pressure wave caused by said ejection energy producing means.

7. An apparatus according to claim 6, wherein said pressure producing means produces a pressure by forming a bubble in the ink.

8. An apparatus according to claim 6, wherein said pressure producing means comprises an electrothermal energy converting element which can cause film boiling of the ink.

9. An apparatus according to claim 6, wherein said ejection energy producing means causes a state change in the ink by thermal energy, and ejects the ink from said ejection orifices based on the state change.

10. An apparatus according to claims 9, wherein said ejection energy producing means causes film boiling in the ink by thermal energy, and ejects the ink from said ejection orifices based on formation of a bubble by the film boiling.

11. An apparatus according to claim 10, wherein said control means controls said pressure producing means to produce the pressurized state before the bubble formed by said ejection energy producing means reaches a maximum bubble length.

12. An ink jet recording apparatus for performing recording on a recording medium by ejecting an ink, comprising:

a plurality of ejection orifices for ejecting the ink;

a supply portion for supplying the ink stored therein to said plurality of ejection orifices;

a plurality of ejection energy producing means, arranged in said supply portion in correspondence with said plurality of ejection orifices, respectively, for applying energy for ink ejection to the ink and causing propagation of a pressure wave;

a plurality of pressure producing means, arranged in said supply portion at an upstream side, in an ink supply direction, of said ejection energy producing means, each for producing in said supply portion a pressurized state for reducing the propagation of the pressure wave caused by said ejection energy producing means; and control means for controlling the pressurized states produced by said plurality of pressure producing means.

13. An apparatus according to claim 12, wherein each of said plurality of pressure producing means produces pressure by forming a bubble in the ink.

14. An apparatus according to claim 12, wherein each of said plurality of pressure producing means comprises an electrothermal energy converting element.

15. An apparatus according to claim 14, wherein said plurality of pressure producing means are connected in series or in parallel to have different watt densities, and said control means simultaneously controls said plurality of pressure producing means.

16. An apparatus according to claim 12, wherein said control means independently controls said plurality of pressure producing means.

17. An apparatus according to claim 12, further comprising means for driving said plurality of ejection energy producing means, wherein said control means comprises:

detection means for detecting a driven one of said plurality of ejection energy producing means; and selection means for selectively driving said plurality of pressure producing means in accordance with a detection result of said detection means.

18. An apparatus according to claim 12, wherein said supply portion comprises a plurality of nozzles respectively communicating with said plurality of ejection orifices, and a common ink chamber commonly communicates with said plurality of nozzles, and said pressure producing means is arranged in said nozzles.

19. An apparatus according to claim 18, wherein each of said plurality of ejection energy producing means and said plurality of pressure producing means produces pressure by forming a bubble in the ink.

20. An apparatus according to claim 19, wherein each of said plurality of ejection energy producing means and said plurality of pressure producing means comprises an electrothermal energy converting element.

21. An apparatus according to claim 20, wherein said plurality of ejection energy producing means and said plurality of pressure producing means are connected in series or in parallel to have different watt densities, and said control means simultaneously controls said plurality of ejection energy producing means and said plurality of pressure producing means.

22. An ink jet recording method for performing recording on a recording medium by ejecting an ink, comprising the steps of:

providing a recording head comprising: ejection orifices for ejecting the ink; a supply portion, communicating with said ejection orifices, for supplying an ink stored therein to said ejection orifices; ejection energy producing means, arranged in said supply portion, for applying energy for ink ejection to the ink and causing propagation of a pressure wave; and pressure producing means, arranged in said supply portion at an upstream side, in an ink supply direction, of said ejection energy producing means, for producing a pressurized state in said supply portion, wherein said supply portion comprises nozzles respectively communicating with said ejection orifices and a chamber communicating with said nozzles, said pressure producing means being arranged in said chamber;

driving said pressure producing means, so that said pressure producing means produces the pressurized state to increase at the upstream side, in the ink supply direction, of said supply portion an impedance for reducing the propagation of the pressure wave caused by said ejection energy producing means; and driving said ejection energy producing means for ink ejection after said pressure producing means is driven.

23. An ink jet recording method for performing recording on a recording medium by ejecting an ink, comprising the steps of:

providing a recording head comprising: a plurality of ejection orifices for ejecting the ink; a supply portion for supplying the ink stored therein to said plurality of ejection orifices; a plurality of ejection energy producing means, arranged in said supply portion in correspondence with said plurality of ejection orifices, for applying energy for ink ejection to the ink and causing propagation of a pressure wave; and a plurality of pressure producing means, arranged in said supply portion at an upstream side, in an ink supply direction, of said ejection energy producing means, for producing a pressurized state in said supply portion;

driving one of said plurality of pressure producing means, so that one of said pressure producing means produces the pressurized state to increase at an upstream side, in an ink supply direction, of said supply portion an impedance for reducing the propagation of the pressure wave caused by said election energy producing means;

driving corresponding ones of said plurality of ejection energy producing means for ink ejection after one of said plurality of pressure producing means is driven; and repeating the driving steps of said plurality of pressure producing means and said plurality of ejection energy producing means.

24. An ink jet recording apparatus for performing recording on a recording medium by ejecting an ink, comprising:

a plurality of ejection orifices for ejecting the ink;

a supply portion, communicating with said ejection orifices, for supplying the ink stored therein to said ejection orifices;

ejection energy producing means, arranged in said supply portion, for applying energy for ink ejection to the ink, said ejection energy producing means causing propagation of a first pressure wave;

pressure producing means, arranged in said supply portion at a position different from said ejection energy producing means, for producing a second pressure wave in said supply portion; and control means for controlling said pressure producing means to produce the second pressure wave different from the first pressure wave produced in said supply portion by said ejection energy producing means, wherein said control means controls said pressure producing means to produce the second pressure wave for reducing the propagation of the first pressure wave according to a number of record dots to be recorded in a predetermined range or a change in the number of record dots.

25. An apparatus according to claim 24, wherein the predetermined record range is one column.

26. An ink jet recording apparatus for performing recording on a recording medium by ejecting an ink, comprising:

an ejection orifice for ejecting the ink;

a supply portion, communicating with said ejection orifice, for supplying the ink stored therein to said ejection orifice;

ejection energy producing means, arranged in said supply portion, for applying energy for ink ejection to the ink, said ejection energy producing means causing propagation of a first pressure wave, the ink in said supply portion forming a meniscus movable by a recession amount upon election of the ink by said ejection energy producing means;

pressure producing means, arranged in said supply portion at a position different from said ejection energy producing means, for producing a second pressure wave in said supply portion; and control means for controlling said pressure producing means to produce the second pressure wave different from the first pressure wave produced in said supply portion by said ejection energy producing means, wherein said control means controls said pressure producing means to produce the second pressure wave for reducing the propagation of the first pressure wave before the recession amount of the meniscus formed upon ejection of the ink by said ejection energy producing means becomes maximum.

27. An ink jet recording apparatus for performing recording on a recording medium by ejecting an ink, comprising:

an ejection orifice for ejecting the ink;

a supply portion, communicating with said ejection orifice, for supplying the ink stored therein to said ejection orifice;

ejection energy producing means, arranged in said supply portion, for applying energy for ink ejection to the ink, said ejection energy producing means causing propagation of a first pressure wave;

pressure producing means, arranged in said supply portion at a position different from said ejection energy producing means, for producing a second pressure wave in said supply portion; and control means for controlling said pressure producing means to produce the second pressure wave different from the first pressure wave produced in said supply portion by said ejection energy producing means, for reducing the propagation of the first pressure wave, wherein said control means randomly changes a timing of and a resulting waveform of the second pressure wave produced in said supply portion.

28. An apparatus according to claim 24, 26 or 27, wherein said pressure producing means comprises said electro-thermal transducer for producing a pressure wave by forming the bubble in the ink.

29. An apparatus according to claim 28, wherein said electro-thermal transducer comprises an electrothermal energy converting element which can cause film boiling of the ink.

30. An apparatus according to claim 24, 26 or 27, wherein said ejection energy producing means causes a state change in the ink by thermal energy, and ejects the ink from said ejection orifice based on the state change.

31. An apparatus according to claim 24, 26 or 27, wherein a plurality of said ejection orifices are arranged, and said supply portion comprises a plurality of nozzles respectively communicating with said plurality of ejection orifices, and a common chamber commonly communicates with said plurality of nozzles.

32. An ink jet recording apparatus for performing recording on a recording medium by ejecting an ink, comprising:

an ejection orifice for ejecting the ink;

a supply portion, communicating with said ejection orifice, for supplying the ink stored therein to said ejection orifice;

ejection energy producing means, arranged in said supply portion, for applying energy for ink ejection to the ink, said ejection energy producing means causing propagation of a first pressure wave;

pressure producing means, arranged in said supply portion at a position different from said ejection energy producing means, for producing a second pressure wave in said supply portion;

receiving means for receiving information regarding at least one of a temperature and an ink remaining amount; and control means for controlling said pressure producing means to produce the second pressure wave different from the first pressure wave produced in said supply portion by said ejection energy producing means, for reducing propagation of the first pressure wave, wherein said control means controls said pressure producing means to produce the second pressure wave at a period according to the information regarding at least one of the temperature and the ink remaining amount.

* * * * *

UNITED STATES PATENT AND TRADEMARK OFFICE

CERTIFICATE OF CORRECTION

PATENT NO. : 5,943,073

DATED : August 24, 1999

INVENTOR(S): NAOJI OTSUKA, ET AL.

It is certified that error appears in the above-identified patent and that said Letters Patent is hereby corrected as shown below:

COVER PAGE AT ITEM [56] References Cited,
Foreign Patent Documents: "04964533 7/1992" should read --0 496 533 7/1992--.

COLUMN 8,
Line 31, "84 b" should read --84b--; and
Line 33, "84C" should read --84c--.

COLUMN 15,
Line 34, "transfering" should read --transforms--.

COLUMN 25,
Line 37, "in." should read --in--.

COLUMN 26,
Line 8, "manly" should read --recording mainly--; and
Line 27, "cases upon, the" should read --cases, upon the--.

COLUMN 27,
Line 1, "election" should read --ejection--.

UNITED STATES PATENT AND TRADEMARK OFFICE

CERTIFICATE OF CORRECTION

PATENT NO. : 5,943,073

DATED : August 24, 1999

INVENTOR(S): NAOJI OTSUKA, ET AL.

It is certified that error appears in the above-identified patent and that said Letters Patent is hereby corrected as shown below:

COLUMN 30,
Line 26, "election" should read --ejection--.

COLUMN 31,
Line 6, "election" should read --ejection--.

Signed and Sealed this

Twenty-third Day of May, 2000

*Attest:*

Q. TODD DICKINSON

*Attesting Officer*

*Director of Patents and Trademarks*